US009522461B2

(12) United States Patent
Oomori et al.

(10) Patent No.: US 9,522,461 B2
(45) Date of Patent: Dec. 20, 2016

(54) IMPACT TOOL

(75) Inventors: Katsuhiro Oomori, Hitachinaka (JP); Mizuho Nakamura, Hitachinaka (JP); Yutaka Ito, Hitachinaka (JP); Nobuhiro Takano, Hitachinaka (JP); Tomomasa Nishikawa, Hitachinaka (JP); Hironori Mashiko, Hitachinaka (JP); Shigeru Takahashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 539 days.

(21) Appl. No.: 13/698,191

(22) PCT Filed: Jun. 30, 2011

(86) PCT No.: PCT/JP2011/065630

§ 371 (c)(1),
(2), (4) Date: Nov. 15, 2012

(87) PCT Pub. No.: WO2012/002578

PCT Pub. Date: Jan. 5, 2012

(65) Prior Publication Data

US 2013/0087355 A1 Apr. 11, 2013

(30) Foreign Application Priority Data

Jun. 30, 2010 (JP) ..... 2010-150360
Apr. 28, 2011 (JP) ..... 2011-100982
Jun. 15, 2011 (JP) ..... 2011-133408

(51) Int. Cl.
*B25B 21/02* (2006.01)
*B25B 21/00* (2006.01)
*B25D 16/00* (2006.01)

(52) U.S. Cl.
CPC ..... *B25B 21/02* (2013.01); *B25B 21/00* (2013.01); *B25B 21/026* (2013.01); *B25D 16/006* (2013.01)

(58) Field of Classification Search
CPC ..... B25B 21/00; B25B 21/026; E02D 7/06
(Continued)

(56) References Cited

U.S. PATENT DOCUMENTS 6,457,535 B1 * 10/2002 Tanaka ..... 173/48
6,691,796 B1 2/2004 Wu
(Continued)

FOREIGN PATENT DOCUMENTS

CN 101011821 A 8/2007
CN 101362319 A 2/2009
(Continued)

OTHER PUBLICATIONS

International Report on Patentability for application PCT/JP2011/065630 (Jan. 17, 2013).
(Continued)

*Primary Examiner* — Nathaniel Chukwurah
(74) *Attorney, Agent, or Firm* — Kilpatrick Townsend & Stockton LLP

(57) ABSTRACT

An impact tool (1) includes a motor (3); a hammer (42) having a rotational axis extending in a first direction, the hammer (42) being rotatable in a rotational direction including a forward direction and a reverse direction opposite to the forward direction by the motor (3) and being movable in the first direction and a second direction opposite to the first direction; an anvil (52) disposed at the first direction side of the hammer (42) and strikable by the hammer (42) in the forward direction, the hammer (42) that has been struck the anvil (52) being moved in the second direction to come free from the anvil (52); and a fixing member (45A, 46A) that selectively allows the hammer (42) to move in the second direction or prevents the hammer (42) from moving in the second direction.

18 Claims, 35 Drawing Sheets

(58) Field of Classification Search
USPC ..... 173/47, 48, 171, 176, 94
See application file for complete search history.

(56) References Cited

U.S. PATENT DOCUMENTS

| | | | | |
|---|---|---|---|---|
| 7,093,951 | B2 * | 8/2006 | Tsuruta et al. | B25B 23/18 362/119 |
| 7,320,368 | B2 | 1/2008 | Watanabe | |
| 7,673,702 | B2 | 3/2010 | Johnson et al. | |
| 2005/0199404 | A1 | 9/2005 | Furuta et al. | |
| 2006/0090913 | A1 * | 5/2006 | Furuta | 173/48 |
| 2006/0254785 | A1 | 11/2006 | Watanabe | |
| 2007/0179328 | A1 | 8/2007 | Murakami et al. | |
| 2007/0210733 | A1 * | 9/2007 | Du et al. | 318/268 |
| 2010/0071923 | A1 * | 3/2010 | Rudolph et al. | 173/48 |
| 2010/0283332 | A1 * | 11/2010 | Toukairin et al. | 310/50 |
| 2010/0326686 | A1 | 12/2010 | Leong et al. | |

FOREIGN PATENT DOCUMENTS

| | | | |
|---|---|---|---|
| EP | 1050381 | A2 | 11/2000 |
| EP | 1714723 | A2 | 10/2006 |
| EP | 1714745 | A | 10/2006 |
| EP | 1946892 | A2 | 7/2008 |
| EP | 2168724 | A1 | 3/2010 |
| EP | 2558247 | B1 | 10/2014 |
| GB | 2441670 | A | 3/2008 |
| JP | 02-139182 | A | 5/1990 |
| JP | 2828640 | B2 | 5/1990 |
| JP | 06-39739 | A | 2/1994 |
| JP | 08-192370 | A | 7/1996 |
| JP | 2513620 | Y | 10/1996 |
| JP | 11-123664 | A | 5/1999 |
| JP | 2000-317854 | A | 11/2000 |
| JP | 2001-105214 | A | 4/2001 |
| JP | 2001-121439 | A | 5/2001 |
| JP | 2004-015986 | A | 1/2004 |
| JP | 2004-249418 | A | 9/2004 |
| JP | 2006-315162 | A | 11/2006 |
| JP | 2008-055580 | A | 3/2008 |
| JP | 2008-119760 | A | 5/2008 |
| JP | 2009-006416 | A | 1/2009 |
| JP | 2010-064247 | A | 3/2010 |
| JP | 2010-519059 | A | 6/2010 |
| JP | 2010-264534 | A | 11/2010 |
| JP | 2011-062771 | A | 3/2011 |
| JP | 2011-083870 | A | 4/2011 |
| RU | 2035290 | C1 | 5/1995 |
| RU | 2313441 | C2 | 12/2007 |
| RU | 2007-0134123 | A | 3/2009 |
| SU | 308864 | C1 | 8/1971 |
| SU | 1438956 | A1 | 11/1988 |
| TW | 556637 | U | 10/2003 |
| WO | WO2007/119597 | A1 | 10/2007 |
| WO | WO2011046029 | A1 | 4/2011 |

OTHER PUBLICATIONS

Taiwan Intellectual Property Office office action for patent application 100123260 (Feb. 4, 2014).
China Intellectual Property Office office action for application CN201180032865.0 dated Jun. 3, 2014.
Russia Federal Service for Intellectual Property office action for application RU2012157631 (May 21, 2014).
Japan Patent Office office action for patent application JP2011-133408 (Nov. 4, 2014).
Japan Patent Office office action for patent application JP2011-100982 (Nov. 20, 2014).
Russia Federal Service for Intellectual Property office action for application RU2012157631 (Dec. 16, 2014).
Office Action for Korean Intellectual Property Office patent application KR10-2012-7028054 (Dec. 11, 2013).
International Search Report for application PCT/JP2011/065630 (Sep. 1, 2011).
Japan Patent Office office action for patent application JP2015-200958 dated Jul. 7, 2016.
Japan Patent Office Notice of Opposition to JP5822085(application JP2010-150360) dated May 23, 2016.

* cited by examiner

IMPACT TOOL

TECHNICAL FIELD

The invention relates to an impact tool.

BACKGROUND ART

Japanese Patent Application Publication No. 2010-264534 provides an impact driver that performs a fastening work by rotating a hammer in only forward direction. The impact driver can provide a strong fastening force although noise during fastening work is loud.

On the other hands, Japanese Patent Application Publication No. 2011-62771 provides an electronic pulse driver that performs a fastening work by rotating a hammer in both forward direction and reverse direction. The electronic pulse driver can provide a fastening force with a small noise although the fastening force is small compared with the impact driver.

DISCLOSURE OF INVENTION

Technical Solution

It is an object of the invention to provide an impact tool capable of selectively serving as an impact driver or an electronic pulse driver.

In order to attain the above and other objects, the invention provides an impact tool including a motor; a hammer having a rotational axis extending in a first direction, the hammer being rotatable in a rotational direction including a forward direction and a reverse direction opposite to the forward direction by the motor and being movable in the first direction and a second direction opposite to the first direction; an anvil disposed at the first direction side of the hammer and strikable by the hammer in the forward direction, the hammer that has been struck the anvil being moved in the second direction to come free from the anvil; and a fixing member that selectively allows the hammer to move in the second direction or prevents the hammer from moving in the second direction.

With this construction, a user can selectively use the impact tool as the impact driver or the electronic pulse driver.

Preferably, the impact tool further includes a controller configured to control the motor so that the hammer is sequentially rotated, when the fixing member allows the hammer to move in the second direction, and so that the hammer is intermittently rotated, when the fixing member prevents the hammer from moving in the second direction.

With this construction, the impact tool can operate at an impact mode when the fixing member allows the hammer to move in the second direction, and can operate at an electronic pulse mode when the fixing member prevents the hammer from moving in the second direction.

Preferably, the impact tool further includes an operating member for instructing the fixing member to allow the hammer to move in the second direction or prevent the hammer from moving in the second direction.

Preferably, the impact tool further includes a case covering the operating member and formed with a groove having a first groove and a second groove, wherein the operating member protrudes from the groove, the hammer being allowed to move in the second direction when the fixing member protrudes from the first groove, and being prevented from moving in the second direction when the fixing member protrudes from the first second groove.

Preferably, the first groove and the second groove are connected with one another, the first groove extending in the first direction, the second groove extending in the rotational direction.

With this construction, the mode is prevented from being switched due to the vibration of the impact tool.

Preferably, the impact tool further includes a plurality of operating units, wherein the case is formed with a plurality of grooves, the plurality of operating members protruding from the plurality of grooves, respectively.

Preferably, the impact tool further includes a receiving member that receives the hammer moving in the second direction and having a first protrusion protruding in the second direction; and a contacting member disposed at the second direction side of the receiving member and having a second protrusion protruding in the first direction, wherein the hammer is prevented from moving in the second direction when the first protrusion is opposed to the second protrusion in the first direction.

Preferably, the impact tool further includes a receiving member that receives the hammer moving in the second direction; and a low frictional member disposed between the hammer and the receiving member.

With this construction, it becomes possible to suppress the occurrence of the rotational friction between the hammer and the receiving member when the hammer is moved in the second direction.

Preferably, the impact tool further includes a supporting member that loosely supports the low friction member with respect to the receiving member in the second direction.

With this construction, it becomes possible to suppress the occurrence of the rotational friction between the supporting member and the low friction member when the hammer is moved in the second direction.

Another aspect of the present invention provides an impact tool including a motor; a hammer having a rotational axis extending in a first direction, the hammer being rotatable in a rotational direction including a forward direction and a reverse direction opposite to the forward direction by the motor and being movable in the first direction and a second direction opposite to the first direction; an anvil disposed at the first direction side of the hammer and strikable by the hammer in the forward direction, the hammer that has struck the anvil being movable in the second direction to come free from the anvil; and a controller configured to rotate the motor in the forward direction at a power such that the hammer that has struck the anvil is prevented from riding over the anvil, and rotates the motor in the reverse direction after the hammer has struck the anvil.

With this construction, the impact tool can achieve the electronic pulse mode with a simple construction although the hammer is not fixed in the second direction.

Preferably, the impact tool further includes a setting unit in which one of a first mode and a second mode is settable as an operation mode of the hammer, wherein when the first mode is set, the controller rotates the motor in the forward direction at a power such that the hammer that has struck the anvil moves in the second direction to ride over the anvil, and wherein when the second mode is set, the controller rotates the motor in the forward direction such that the hammer that has struck the anvil is prevented from riding over the anvil, and rotates in the reverse direction after the hammer has struck the anvil.

With this construction, a user can selectively use the impact tool as the impact driver or the electronic pulse driver.

Preferably, a third mode is further settable in the setting unit, wherein when the third mode is set, before a load applied to the motor increases to a predetermined value, the controller controls the motor at the second mode, and after a load applied to the motor increases to the predetermined value, the controller controls the motor at the first mode.

With this construction, a user can use the impact tool as the electronic pulse driver that provide a fastening force with a small noise although the fastening force is small compared with the impact driver firstly, and can use the impact tool as the impact driver that provides a stronger fastening force than the electronic pulse driver after a load applied to the motor increases to a predetermined value.

Preferably, a fourth mode is further settable in the setting unit, wherein when the fourth mode is set, the controller keeps rotating the motor in the forward direction at a power such that the hammer that has struck the anvil is prevented from riding over the anvil direction.

With this construction, the impact tool can operate at the drill mode.

Advantageous Effects

An impact tool of the present invention can selectively serve as an impact driver or an electronic pulse driver.

EXPLANATION OF REFERENCE

Figure 1:
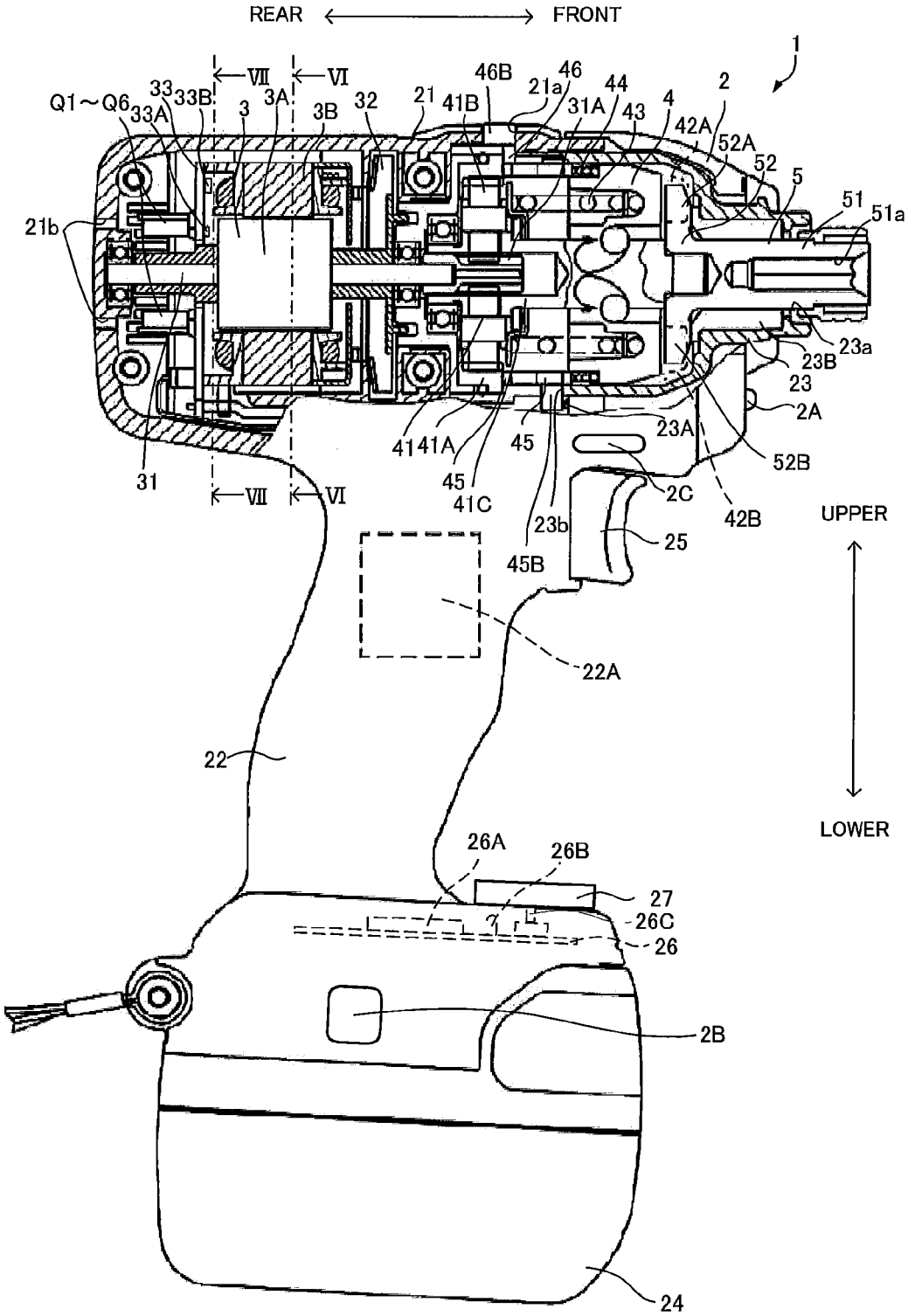
FIG. 1 is a cross-sectional view showing an impact tool in an electronic pulse mode, according to a first embodiment of the invention.

1 impact tool
3 motor
42 hammer
52 anvil
45A, 46A fixing member

BEST MODE FOR CARRYING OUT THE INVENTION

Hereinafter, the configuration of an impact tool 1 according to a first embodiment of the invention will be described while referring to FIGS. 1 through 18.

As shown in FIG. 1, the impact tool 1 mainly includes a housing 2, a motor 3, a hammer section 4, an anvil section 5, an inverter circuit 6 (see FIG. 10) mounted on a circuit board 33, and a control section 7 (see FIG. 10) mounted on a board 26. The housing 2 is made of resin and constitutes an outer shell of the impact tool 1. The housing 2 is mainly formed by a body section 21 having substantially a cylindrical shape and a handle section 22 extending downward from the body section 21.

The motor 3 is disposed within the body section 21 so that the axial direction of the motor 3 matches the lengthwise direction of the body section 21. Within the body section 21, the hammer section 4 and the anvil section 5 are arranged toward one end side of the motor 3 in the axial direction. In descriptions provided below, the anvil section 5 side is defined as a front side, the motor 3 side is defined as a rear side, and a direction parallel to the axial direction of the motor 3 is defined as a front-rear direction. Additionally, the body section 21 side is defined as an upper side, the handle section 22 side is defined as a lower side, and a direction in which the handle section 22 extends from the body section 21 is defined as an upper-lower direction. Further, a direction perpendicular to both the front-rear direction and the upper-lower direction is defined as a left-right direction.

Figure 2:
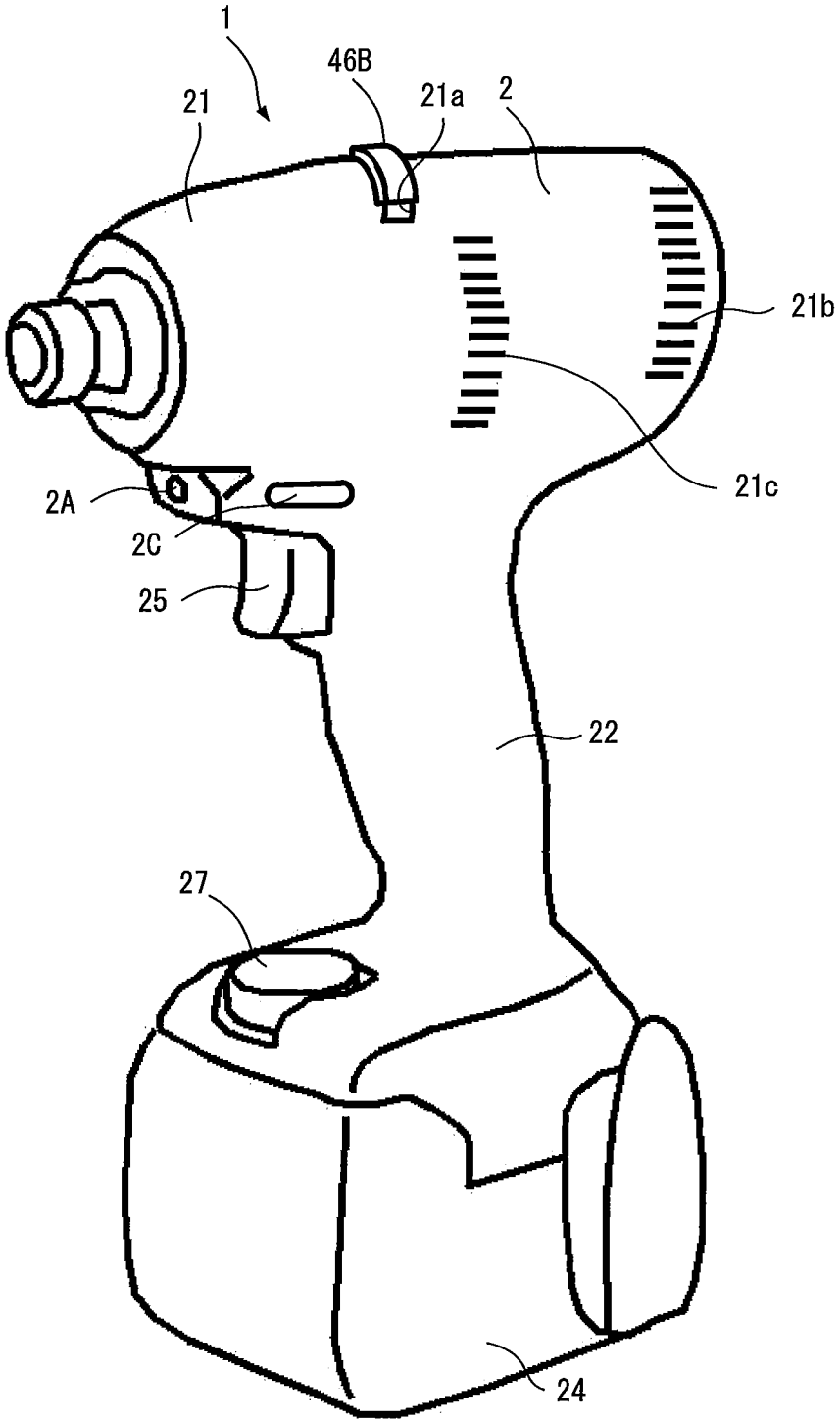
FIG. 2 is a perspective view of the impact tool according to the first embodiment of the invention.

As shown in FIGS. 1 and 2, a first hole 21*a* from which an operating section 46B described later protrudes is formed at an upper section of the body section 21, an air inlet hole 21*b* for introducing ambient air is formed at a rear end and a rear part of the body section 21, and an air outlet hole 21*c* for discharging air is formed at a center part of the body section 21. A metal-made hammer case 23 accommodating the hammer section 4 and the anvil section 5 therein is disposed at a front position within the body section 21. The hammer case 23 has substantially a funnel shape of which diameter becomes smaller gradually forward, and an opening 23*a* is formed at the front end part. A metal 23B is provided on an inner wall defining the opening 23*a*. A second hole 23*b* from which a protruding section 45B described later protrudes is formed at a lower section of the hammer case 23. A switch 23A is provided adjacent to the second hole 23*b*. The switch 23A outputs a signal indicating a main operation mode described later in accordance with the contact with the protruding section 45Br.

A light 2A is provided at a position adjacent to the opening 23*a* and below the hammer case 23 for irradiating a bit mounted on an end-bit mounting section 51 described later. The light 2A is provided to illuminate forward during work at dark places and to light up a work location. The light 2A is lighted normally by turning on a switch 2B described later, and goes out by turning off the switch 2B. The light 2A also has a function of blinking when temperature of the motor 3 rises to inform an operator of the temperature rising, in addition to the original function of illumination of the light 2A.

The handle section 22 extends downward from a substantially center position of the body section 21 in the front-rear direction, and is formed as an integral part with the body section 21. A trigger 25 and a forward-reverse switching lever 2C for switching rotational direction of the motor 3 are provided at an upper section of the handle section 22. The switch 2B and a dial 27 are provided at a lower section of the handle section 22. The switch 2B is for switching on and off of the light 2A, and the dial 27 is for switching a plurality of modes in an electronic pulse mode described later by a rotating operation. A battery 24, which is a rechargeable battery that can be charged repeatedly, is detachably mounted at a lower end section of the handle section 22 in order to supply the motor 3 and the like with electric power. The board 26 is disposed at a lower position within the handle section 22. A switch mechanism 22A is built in the handle section 22 for transmitting an operation of the trigger 25 to the board 26.

Figure 3:
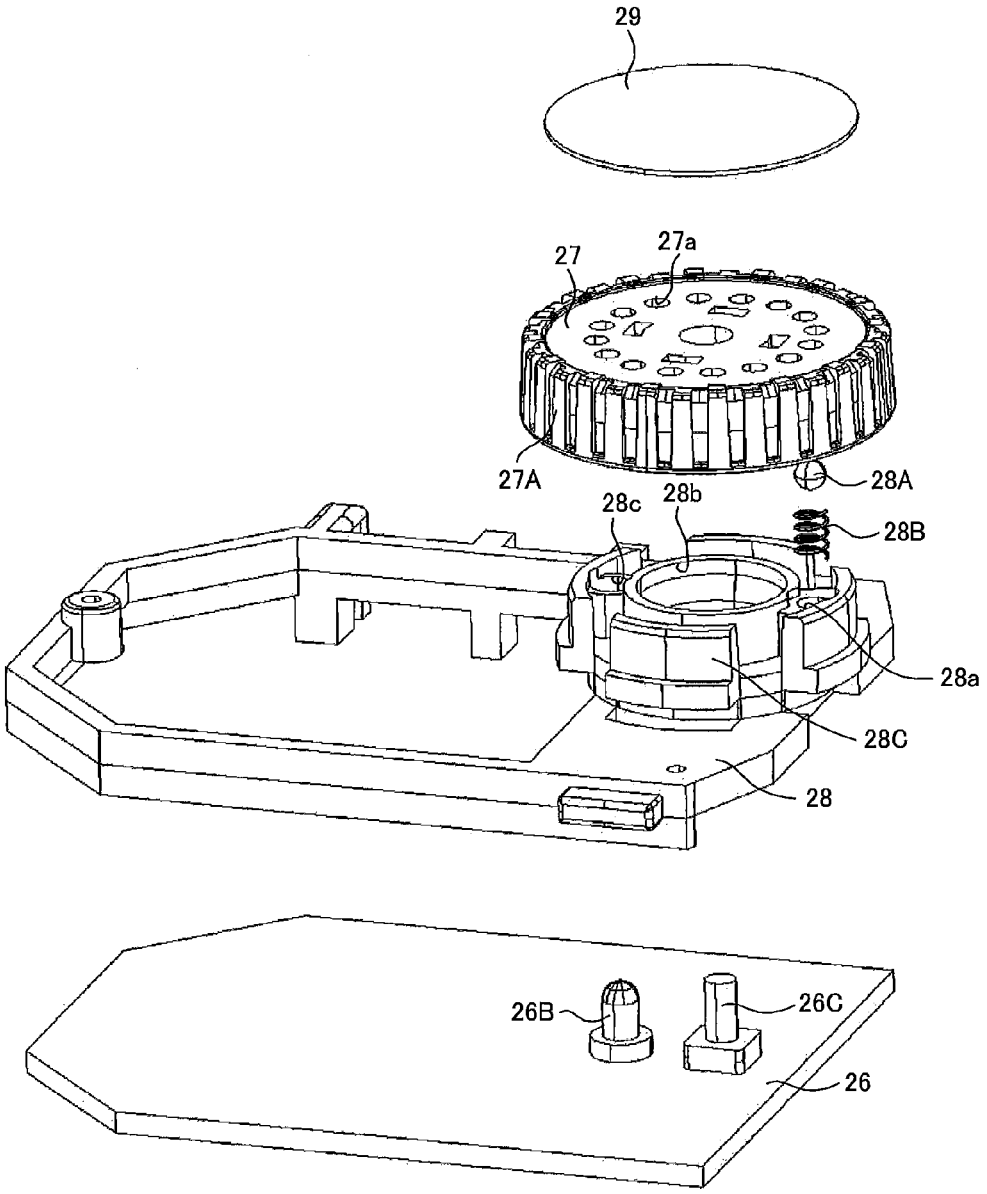
FIG. 3 is an assembly diagram showing a dial and surrounding parts of the impact tool according to the first embodiment of the invention.

The board 26 is supported within the handle section 22 by a rib (not shown). The control section 7, a gyro sensor 26A, an LED 26B, a support protrusion 26C, and a dial-position detecting element 26D (FIG. 10) are provided on the board 26. As shown in FIG. 3, a dial supporting section 28 is also mounted on the board 26, and the dial 27 is placed on the dial supporting section 28.

Here, the structure of the dial 27 and the dial supporting section 28 will be described while referring to FIGS. 3 through 5.

Figure 4:
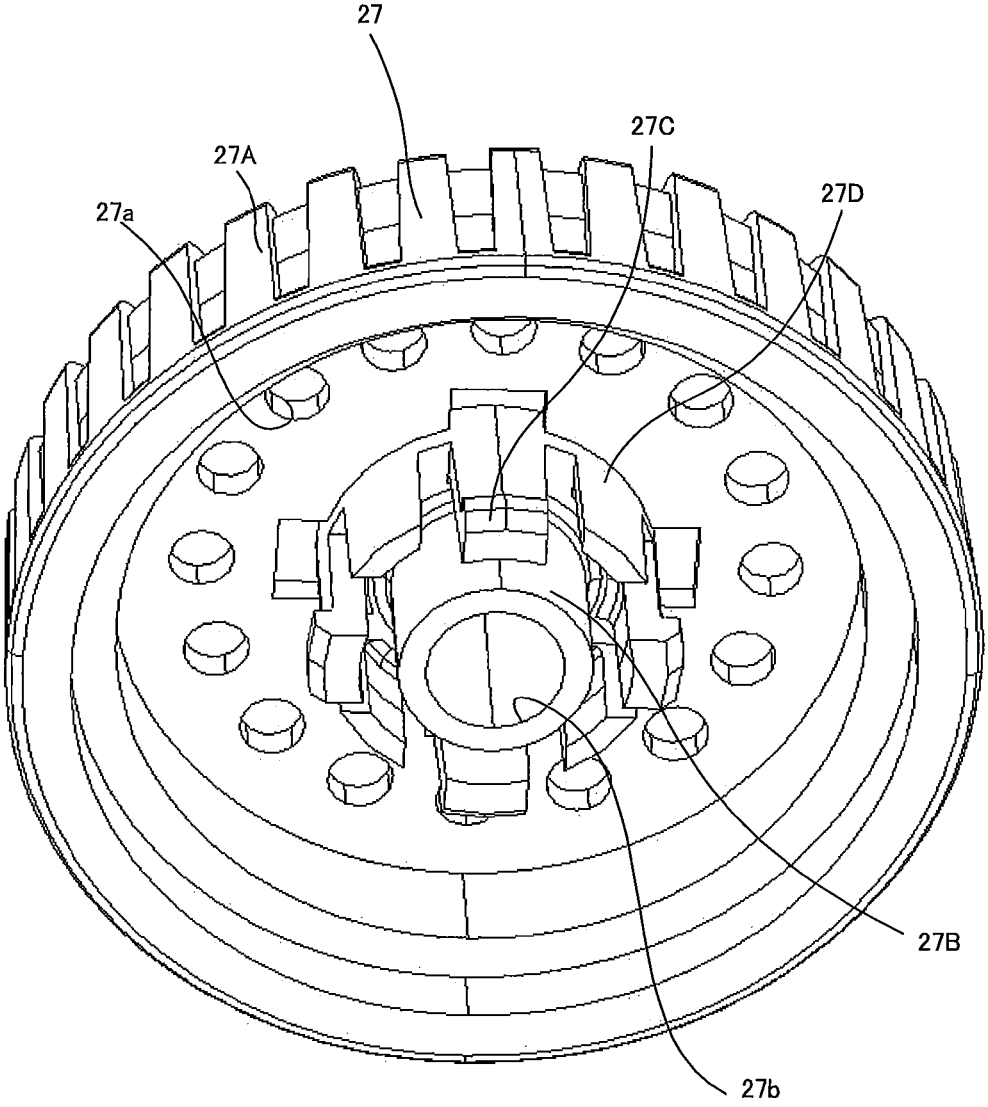
FIG. 4 is a perspective view showing the dial of the impact tool according to the first embodiment of the invention.

As shown in FIG. 4, the dial 27 has a circular shape, and a plurality of through holes 27*a* is formed in a circumferential arrangement on the dial 27. A plurality of concave and convex sections 27A is provided on the outer circumferential surface of the dial 27 for preventing slippage when an operator rotates the dial 27. A substantially cylindrical engaging section 27B is provided at the center of the dial 27 so as to protrude downward in FIG. 1. An engaging hole 27*b* is formed at the center of the engaging section 27B. Four engaging claws 27C and four protrusions 27D are provided around the engaging section 27B so as to surround the engaging section 27B.

As shown in FIG. 3, the dial supporting section 28 has a ball 28A, a spring 28B, and a plurality of guiding protrusions 28C. The dial supporting section 28 is formed with a spring inserting hole 28*a*, an engaged hole 28*b*, an LED receiving hole 28*c* located at the opposite position from the spring inserting hole 28*a* with respect to the engaged hole 28*b*.

The engaging section 27B, the engaging claws 27C, and the protrusions 27D of the dial 27 are inserted into the engaged hole 28*b* from the upper side, and also the support protrusion 26C on the board 26 is inserted into the engaged hole 28*b* from the lower side, thereby allowing the dial 27 to be rotatable about the support protrusion 26C. Further, the guiding protrusions 28C of the dial supporting section 28 are arranged in a circumferential shape so as to fit the inner circumference of the concave and convex sections 27A of the dial 27, and the engaging claws 27C and the protrusions 27D of the dial 27 are also arranged in a circumferential shape so as to fit the engaged hole 28*b* of the dial supporting section 28, which enables smooth rotation of the dial 27. Additionally, the engaged hole 28*b* is provided with a step (not shown) so that the engaging claws 27C inserted in the engaged hole 28*b* engage the step, thereby restricting movement of the dial 27 in the upper-lower direction.

The ball 28A is urged upward by the spring 28B inserted in the spring inserting hole 28*a*. Hence, by rotating the dial 27, a portion of the ball 28A is buried in one of the through holes 27*a*. Because each through hole 27*a* corresponds to one of a plurality of modes in an electronic pulse mode to be described later, the operator can recognize that the mode has changed, from feeling or the like that a portion of the ball 28A is buried in the through hole 27*a*. On the other hand, the LED 26B on the board 26 is inserted in the LED receiving hole 28*c*. Hence, when a portion of the ball 28A is buried in the through hole 27*a*, the LED 26B can irradiate onto the dial seal 29 from the lower side through the through hole 27 *a* located at a 180-degree opposite position on the dial 27 with respect to the engaging hole 27*b* from the through hole 27*a* in which the portion of the ball 28A is buried.

Figure 5:
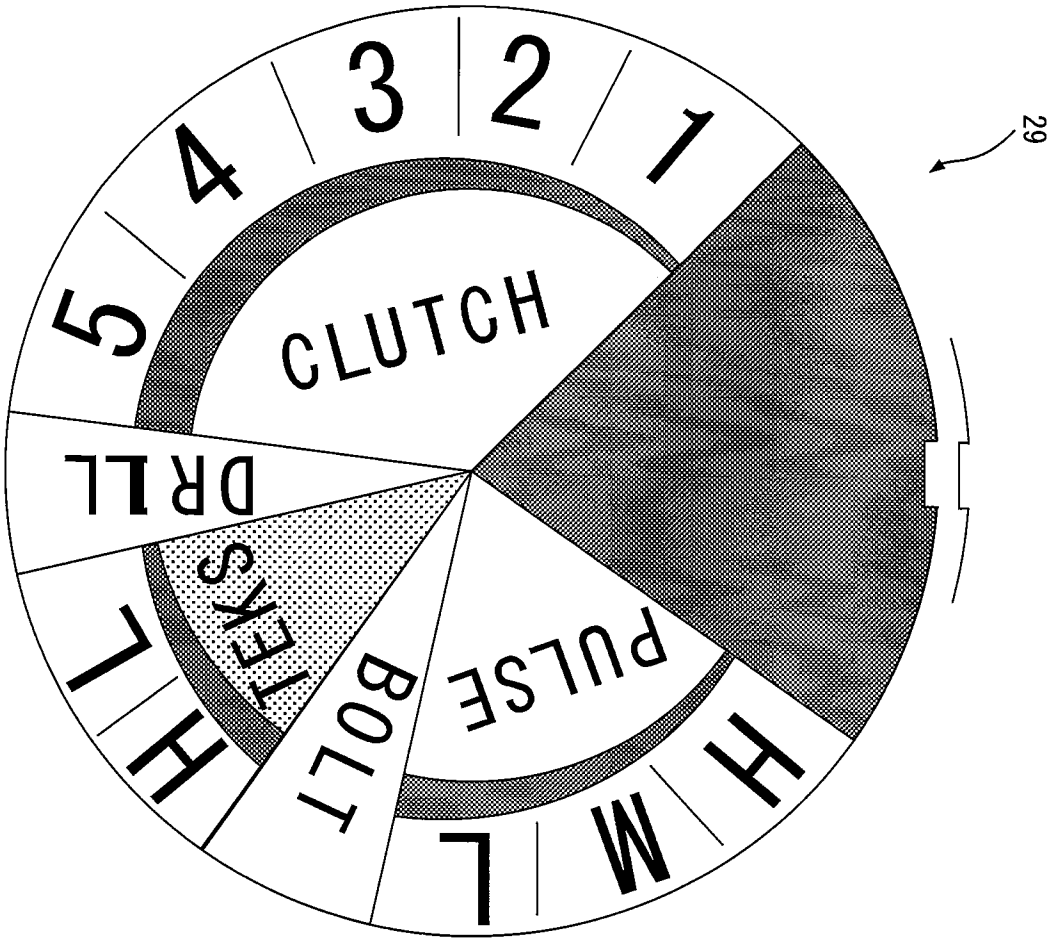
FIG. 5 is a plan view showing a dial seal of the impact tool according to the first embodiment of the invention.

Further, a dial seal 29 shown in FIG. 5 is affixed to the top surface of the dial 27. Characters indicative of a clutch mode, a drill mode, a TEKS (registered trade mark) mode, a bolt mode, and a pulse mode in the electronic pulse mode are shown in transparent letters on the dial seal 29. Operations in each mode will be described later. Each mode can be selected by rotating the dial 27 so that a desired mode is positioned under the LED 26B. At this time, because light of the LED 26B lights up the transparent letters on the dial seal 29, the operator can recognize the mode that is currently set and the location of the dial 27 even during working at dark places.

Figure 6:
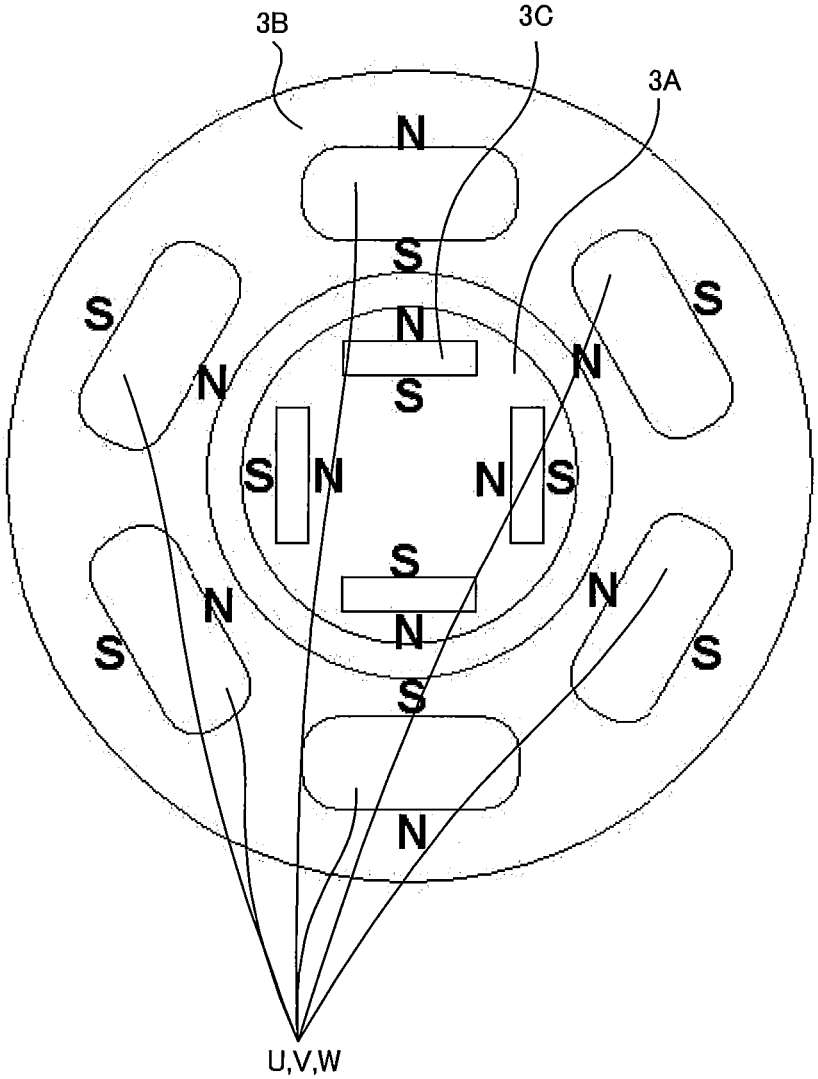
FIG. 6 is a cross-sectional view of the impact tool according to the first embodiment of the invention, taken along a line VI-VI in FIG. 1.

Referring to FIG. 1, the configuration of the impact tool 1 will be described again. As shown in FIG. 1, the motor 3 is a brushless motor that mainly includes a rotor 3A having an output shaft 31 and a stator 3B disposed to confront the rotor 3A. The motor 3 is disposed within the body section 21 so that the axial direction of the output shaft 31 matches the front-rear direction. As shown in FIG. 6, the rotor 3A has a permanent magnet 3C including a plurality of sets (two sets in the present embodiment) of north poles and south poles. The stator 3B is three-phase stator windings U, V, and W in star connection. The south poles and the north poles of the stator windings U, V, and W are switched by controlling electric current flowing through the stator windings U, V, and W, thereby rotating the rotor 3A. Further, the rotor 3A can be made stationary relative to the stator 3B by controlling the stator windings U, V, and W so that a state where one set of the permanent magnet 3C is opposed to the winding U, V, and W (FIG. 6), is maintained.

The output shaft 31 protrudes at the front and the rear of the rotor 3A, and is rotatably supported by the body section 21 via bearings at the protruding sections. A fan 32 is provided at the protruding section of the output shaft 31 at the front side, so that the fan 32 rotates coaxially and together with the output shaft 31. A pinion gear 31A is provided at the front end position of the protruding section of the output shaft 31 at the front side, so that the pinion gear 31A rotates coaxially and together with the output shaft 31.

Figure 7:
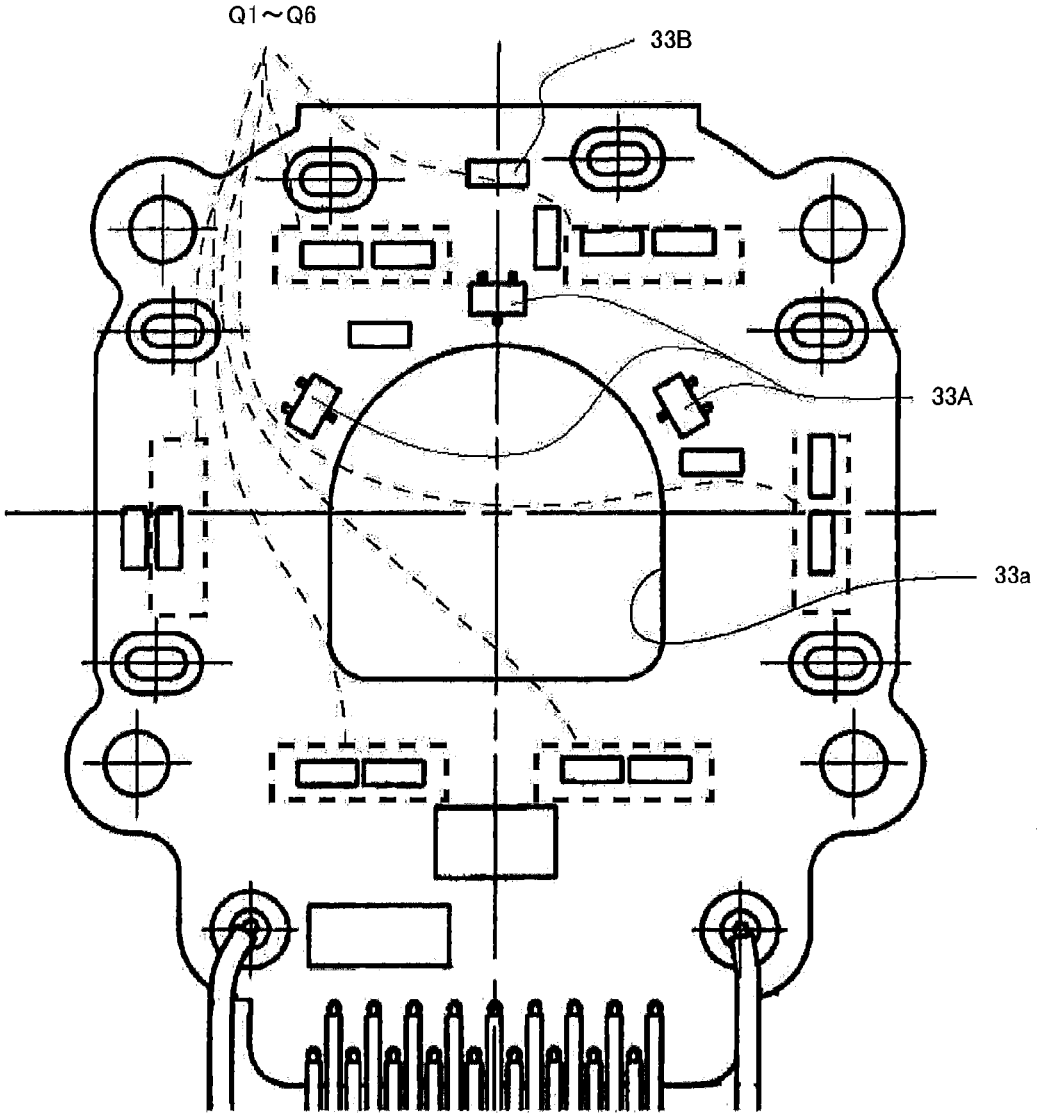
FIG. 7 is a cross-sectional view of the impact tool according to the first embodiment of the invention, taken along a line VII-VII in FIG. 1.

The circuit board 33 for mounting thereon electric elements is disposed at the rear of the motor 3. As shown in FIG. 7, a through hole 33*a* is formed at the center of the circuit board 33, and the output shaft 31 extends through the through hole 33*a*. On the front surface of the circuit board 33, three rotational-position detecting elements (Hall elements) 33A and a thermistor 33B are provided to protrude forward. On the rear surface of the circuit board 33, six switching elements Q1 through Q6 constituting the inverter circuit 6 are provided at the position indicated by dotted lines in FIG. 7. In other words, the inverter circuit 6 includes six switching elements Q1 through Q6 such as FET connected in a three-phase bridge form (see FIG. 10).

The rotational-position detecting elements 33A are for detecting the position of the rotor 3A. The rotational-position detecting elements 33A are provided at positions in confrontation with the permanent magnet 3C of the rotor 3A, and are arranged at a predetermined interval (for example, an interval of 60 degrees) in the circumferential direction of the rotor 3A. The thermistor 33B is for detecting ambient temperature. As shown in FIG. 7, the thermistor 33B is provided at a position of equal distance from the left and right switching elements, and is arranged to overlap with the stator windings U, V, and W of the stator 3B as viewed from the rear. Since the temperature of the rotational-position detecting elements 33A, the switching elements Q1 through Q6, and the motor 3 easily increase, the rotational-position detecting elements 33A, the switching elements Q1 through Q6, and the motor 3 are easy to be damaged. Hence, the thermistor 33B is arranged adjacent to the rotational-position detecting elements 33A, the switching elements Q1 through Q6, and the motor 3, so that the temperature increase of the rotational-position detecting elements 33A, the switching elements Q1 through Q6, and the motor 3 can be detected accurately.

Figure 8:
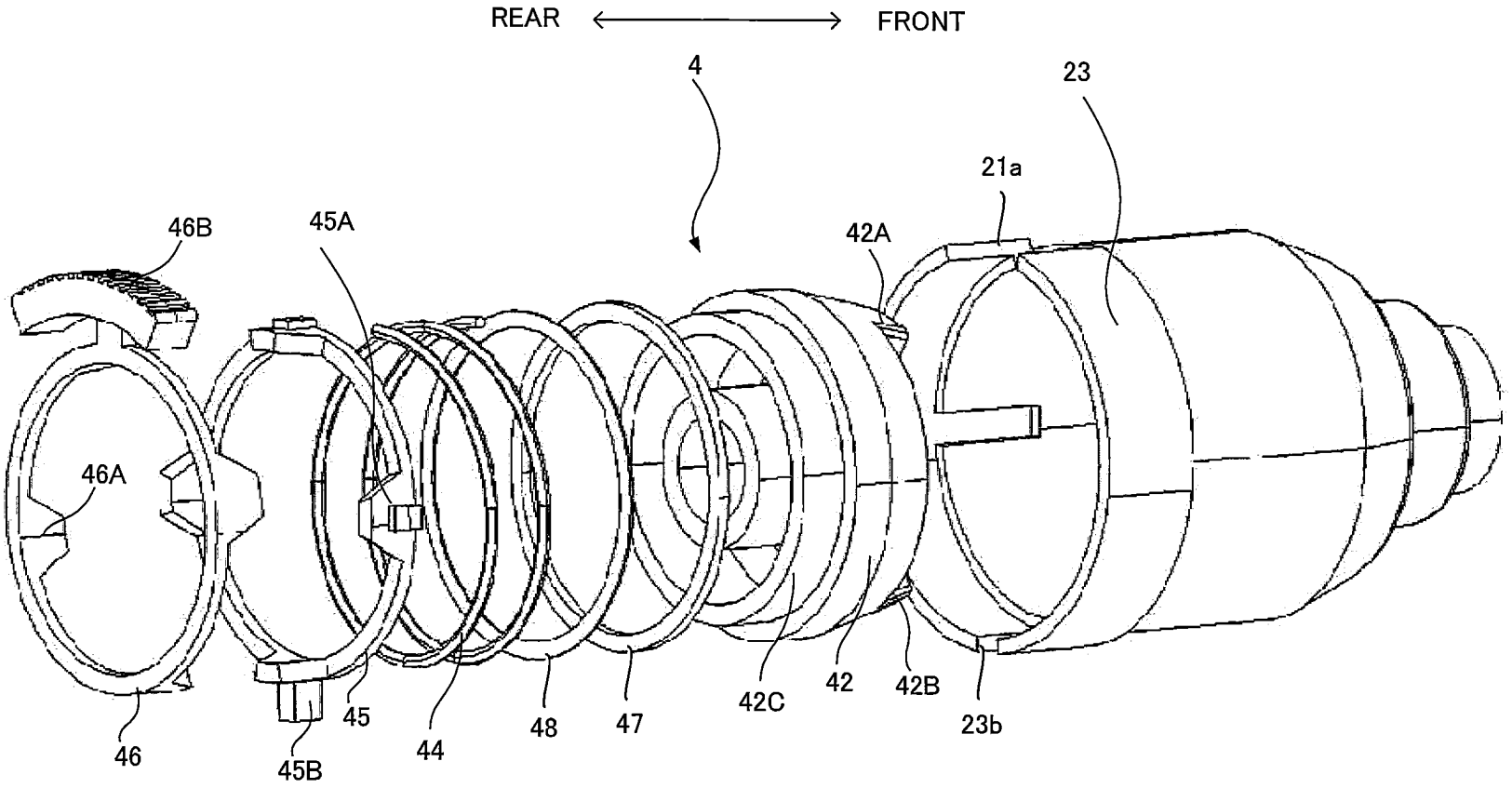
FIG. 8 is an assembly diagram showing a hammer section and surrounding parts of the impact tool according to the first embodiment of the invention.

As shown in FIGS. 1 and 8, the hammer section 4 mainly includes a gear mechanism 41, a hammer 42, an urging spring 43, a regulating spring 44, a first ring-shaped member 45, a second ring-shaped member 46, and washers 47 and 48. The hammer section 4 is accommodated within the hammer case 23 at the front side of the motor 3. The gear mechanism 41 is a single-stage planetary gear mechanism, and includes an outer gear 41A, two planetary gears 41B, and a spindle 41C. The outer gear 41A is fixed within the body section 21.

The two planetary gears 41B are arranged to meshingly engage the pinion gear 31A around the pinion gear 31A serving as the sun gear and to meshingly engage the outer gear 41A within the outer gear 41A. The two planetary gears 41B are connected to the spindle 41C having the sun gear. With such configuration, rotation of the pinion gear 31A causes the two planetary gears 41B to orbit the pinion gear 31A, and rotation decelerated by the orbital motion is transmitted to the spindle 41C.

The hammer 42 is disposed at the front side of the gear mechanism 41. The hammer 42 is rotatable and movable in the front-rear direction together with the spindle 41C. As shown in FIG. 8, the hammer 42 has a first engaging protrusion 42A and a second engaging protrusion 42B that are arranged at opposite positions with respect to the rotational axis and that protrude frontward. A spring receiving section 42C into which the regulating spring 44 is inserted is provided at the rear part of the hammer 42.

As shown in FIG. 1, because the front end of the urging spring 43 is connected to the hammer 42 and the rear end of the urging spring 43 is connected to the front end of the gear mechanism 41, the hammer 42 is always urged toward the front. On the other hand, the hammer section 4 of the present embodiment includes the regulating spring 44. As shown in FIG. 8, the regulating spring 44 is inserted into the spring receiving section 42C via the washers 47 and 48. The front end of the regulating spring 44 abuts on the hammer 42, and the rear end of the regulating spring 44 abuts on the first ring-shaped member 45.

The first ring-shaped member 45 has substantially a ring shape, and has a plurality of trapezoidal first convex sections 45A and a protruding section 45B. The plurality of first convex sections 45A protrudes rearward and is arranged at four positions with intervals of 90 degrees in the circumferential direction. The protruding section 45B protrudes downward and, as shown in FIG. 1, is inserted in the second hole 23*b* formed in the hammer case 23. The second hole 23*b* is formed so that the length in the circumferential direction is substantially identical to the protruding section 45B and that the length in the front-rear direction is longer than the protruding section 45B, and thus the first ring-shaped member 45 is not movable in the circumferential direction and is movable in the front-rear direction.

The second ring-shaped member 46 has substantially a ring shape, and has a plurality of trapezoidal second convex sections 46A and the operating section 46B. The plurality of second convex sections 46A protrudes frontward and is arranged at four positions with intervals of 90 degrees in the circumferential direction. The operating section 46B protrude upward and, as shown in FIG. 1, is exposed to outside through the first hole 21*a*. The first hole 21*a* is formed so that the length in the circumferential direction is longer than the operating section 46B and that the length in the front-rear direction is substantially identical to the operating section 46B, and thus the operator can operate the operating section 46B to rotate the second ring-shaped member 46 in the circumferential direction.

Figure 9:
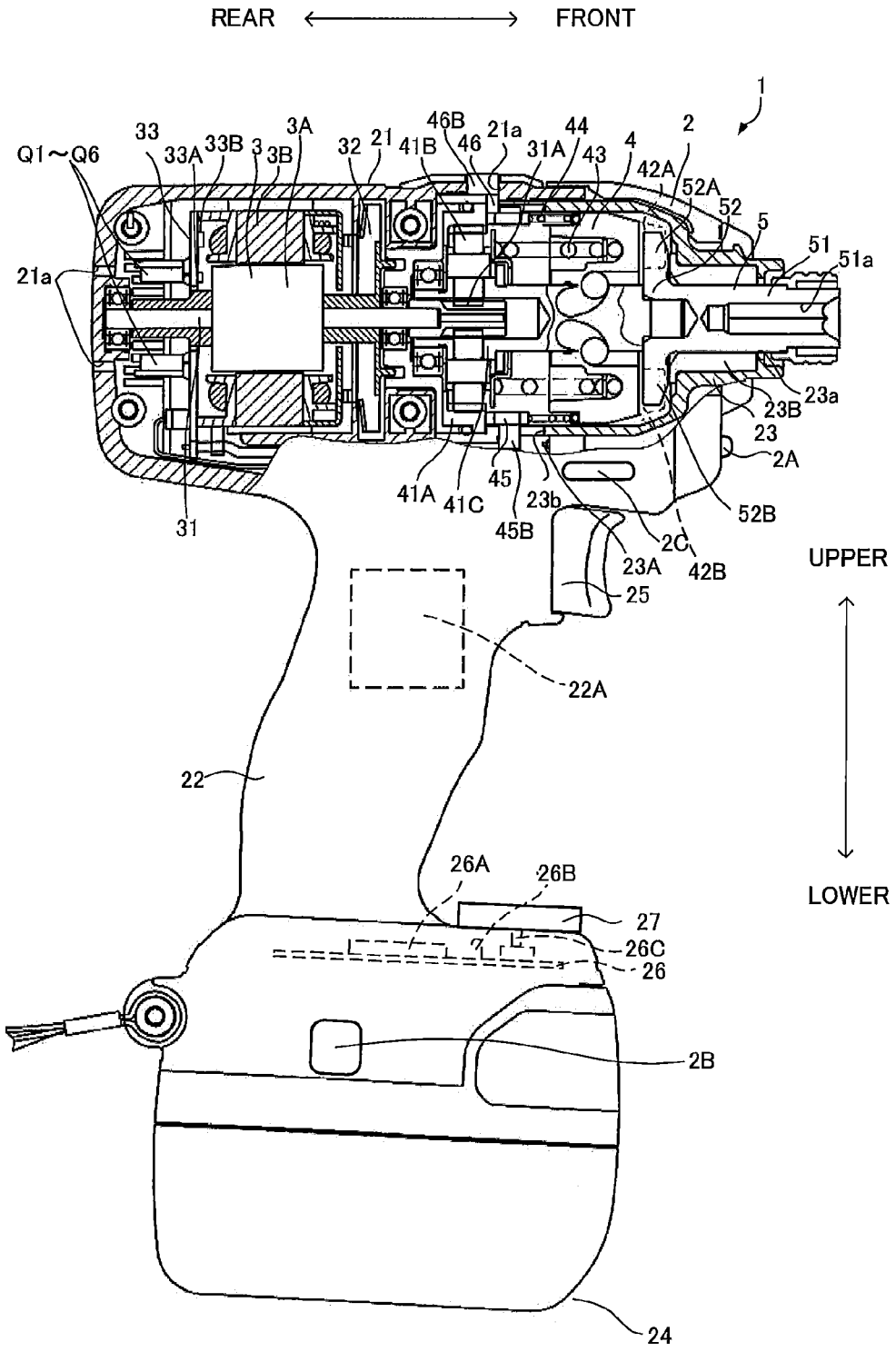
FIG. 9 is a cross-sectional view showing the impact tool in an impact mode, according to the first embodiment of the invention.

When the operating section 46B is not operated, the first convex sections 45A and the second convex sections 46A are located at positions shifted from each other in the circumferential direction, as viewed from the rotational axis direction (the front-rear direction). In this case, since the regulating spring 44 is in a most expanded state as shown in FIG. 9, there is room for the hammer 42 to move rearward against the urging force of the urging spring 43. Note that when the operating section 46B is not operated, the protruding section 45B of the first ring-shaped member 45 and the switch 23A are not in contact with each other.

On the other hand, if the operating section 46B is operated, the second ring-shaped member 46 rotates, and the first convex sections 45A ride on the second convex sections 46A, thereby causing the first ring-shaped member 45 to move forward against the urging force of the regulating spring 44. Hence, since the regulating spring 44 is in a most contracted state, the hammer 42 cannot move rearward. Note that when the operating section 46B is operated, the protruding section 45B and the switch 23A are in contact with each other due to contraction of the regulating spring 44, as shown in FIG. 1.

Referring to FIG. 1, the configuration of the impact tool 1 will be described again. The anvil section 5 is disposed at the front side of the hammer section 4, and mainly includes the end-bit mounting section 51 and an anvil 52. The end-bit mounting section 51 is formed in a cylindrical shape, and is rotatably supported within the opening 23*a* of the hammer case 23 via the metal 23. The end-bit mounting section 51 is formed, in the front-rear direction, with a bore hole 51*a* into which a bit (not shown) is inserted.

The anvil 52 is located at the rear of the end-bit mounting section 51 within the hammer case 23, and is formed as an integral part with the end-bit mounting section 51. The anvil 52 has a first engaged protrusion 52A and a second engaged protrusion 52B that are arranged at opposite positions with respect to the rotational center of the end-bit mounting section 51 and that protrude rearward. When the hammer 42 rotates, the first engaging protrusion 42A and the first engaged protrusion 52A collide with each other and, at the same time, the second engaging protrusion 42B and the second engaged protrusion 52B collide with each other, and the hammer 42 and the anvil 52 rotate together. With this motion, the rotational force of the hammer 42 is transmitted to the anvil 52. The operations of the hammer 42 and the anvil 52 will be described later in greater detail.

The control section 7 mounted on the board 26 is connected to the battery 24, and is also connected to the light 2A, the switch 2B, the forward-reverse switching lever 2C, the switch 23A, the trigger 25, the gyro sensor 26A, the LED 26B, the dial-position detecting element 26D, the dial 27, and the thermistor 33B. The control section 7 includes an electric-current detecting circuit 71, a switch-operation detecting circuit 72, an applied-voltage setting circuit 73, a rotational-direction setting circuit 74, a rotor-position detecting circuit 75, a rotational-speed detecting circuit 76, a striking-impact detecting circuit 77, a calculating section 78, a control-signal outputting circuit 79 (see FIG. 10).

Figure 10:
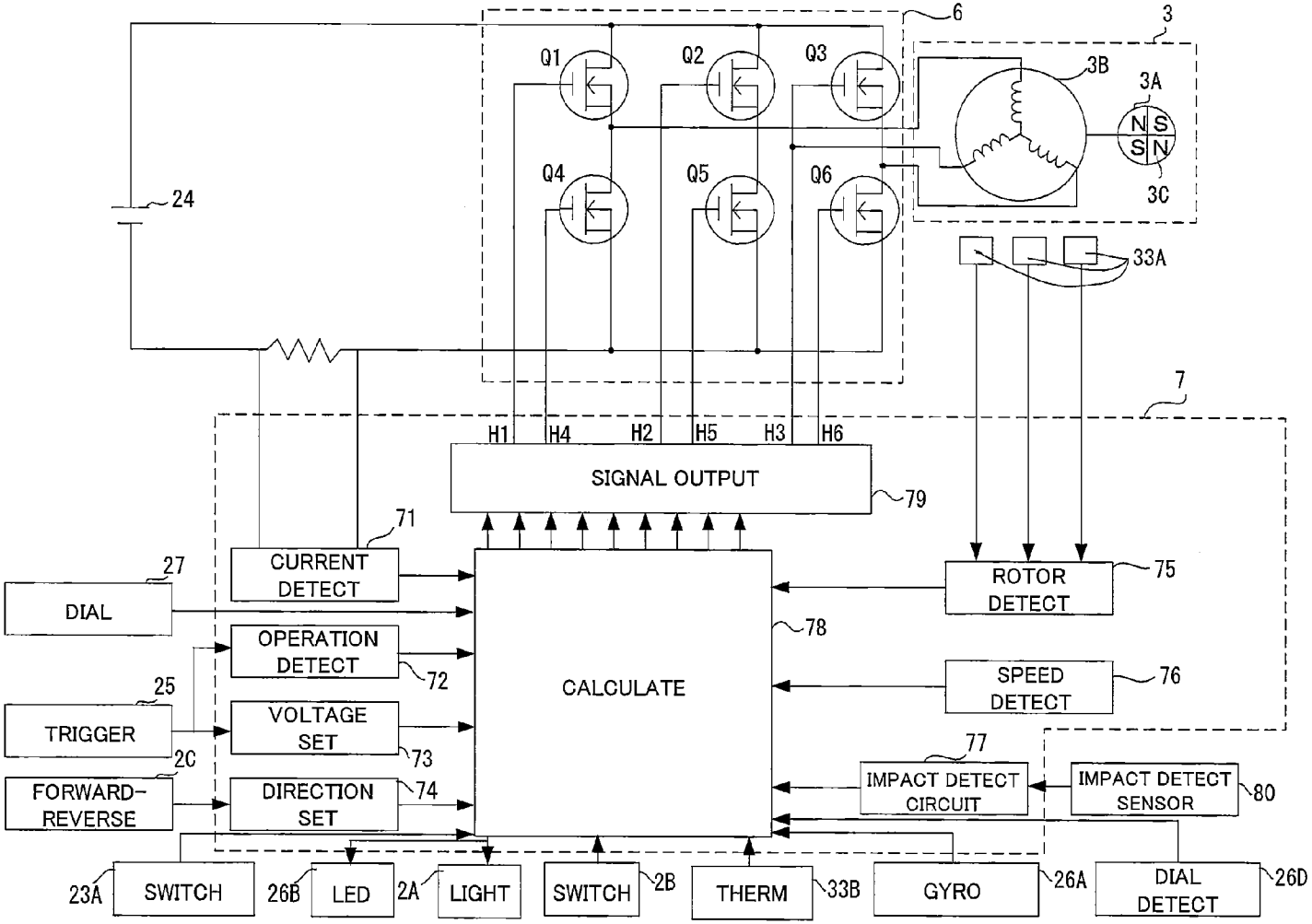
FIG. 10 is a block diagram for illustrating controls of the impact tool according to the first embodiment of the invention.

Next, the configuration of control system for driving the motor 3 will be described with reference to FIG. 10. Each gate of the switching elements Q1 through Q6 of the inverter circuit 6 is connected to the control-signal outputting circuit 79 of the control section 7. Each drain or source of the switching elements Q1 through Q6 is connected to the stator windings U, V, and W of the stator 3B of the three-phase brushless DC motor 3. The six switching elements Q1 through Q6 performs switching operations by switching signals H1-H6 inputted from the control-signal outputting circuit 79. Thus, the DC voltage of the battery 24 applied to the inverter circuit 6 is supplied to the stator windings U, V, and W as three-phase (U-phase, V-phase, and W-phase) voltages Vu, Vv, and Vw, respectively.

Specifically, the energized stator winding U, V, W, that is, the rotational direction of the rotor 3A is controlled by the switching signals H1-H6 inputted to the switching elements Q1-Q6. Further, an amount of power supply to the stator winding U, V, W, that is, the rotational speed of the rotor 3A is controlled by the switching signals H4, H5, and H6 that are inputted to the switching elements Q4-Q6 and also serve as pulse width modulation signals (PWM signals).

The electric-current detecting circuit 71 detects a current value supplied to the motor 3, and outputs the detected current value to the calculating section 78. The switch-operation detecting circuit 72 detects whether the trigger 25 has been operated, and outputs the detection result to the calculating section 78. The applied-voltage setting circuit 73 outputs a signal depending on an operated amount of the trigger 25 to the calculating section 78.

Upon detecting switching of the forward-reverse switching lever 2C, the rotational-direction setting circuit 74 transmits a signal for switching the rotational direction of the motor 3 to the calculating section 78.

The rotor-position detecting circuit 75 detects the rotational position of the rotor 3A based on a signal from the rotational-position detecting elements 33A, and outputs the detection result to the calculating section 78. The rotational-speed detecting circuit 76 detects the rotational speed of the rotor 3A based on a signal from the rotational-position detecting elements 33A, and outputs the detection result to the calculating section 78.

The impact tool 1 is provided with a striking-impact detecting sensor 80 that detects magnitude of an impact that occurs at the anvil 52. The striking-impact detecting circuit 77 outputs a signal from the striking-impact detecting sensor 80 to the calculating section 78.

The calculating section 78 includes a central processing unit (CPU) for outputting driving signals based on processing programs and data, a ROM for storing the processing programs and control data, a RAM for temporarily storing data, and a timer, although these elements are not shown.

The calculating section 78 generates the switching signals H1-H6 based on signals from the rotational-direction setting circuit 74, the rotor-position detecting circuit 75 and the rotational-speed detecting circuit 76, and outputs these signals to the inverter circuit 6 via control-signal outputting circuit 79. Further, the calculating section 78 adjusts the switching signals H4-H6 based on a signal from the applied-voltage setting circuit 73, and outputs these signals to the inverter circuit 6 via the control-signal outputting circuit 79. Note that the switching signals H1-H3 may be adjusted as the PWM signals.

Further, ON/OFF signals from the switch 2B and temperature signals from the thermistor 33B are inputted into the calculating section 78. Lighting on, blinking, and lighting off of the light 2A are controlled based on these signals, thereby informing the operator of a temperature increase in the housing 2.

The calculating section 78 switches the operation mode to an electronic pulse mode to be described later, based on an input of a signal generated when the protruding section 45B contacts the switch 23A. Further, the calculating section 78 turns on the LED 26B for a predetermined period, based on an input of a signal generated when the trigger 25 is pulled.

Signals from the gyro sensor 26A are also inputted into the calculating section 78. The calculating section 78 controls the rotational direction of the motor 3 by detecting a velocity of the gyro sensor 26A. The detailed operations will be described later.

Further, signals from the dial-position detecting element 26D that detects a position of the dial 27 in the circumferential direction are inputted into the calculating section 78. The calculating section 78 performs switching of the operation mode based on the signals from the dial-position detecting element 26D.

Next, the usable operation modes and controls of the control section 7 in the impact tool 1 according to the present embodiment will be described. The impact tool 1 according to the present embodiment has two main modes of the impact mode and the electronic pulse mode. The main modes can be switched by operating the operating section 46B to put the switch 23A and the protruding section 45B in contact and out of contact with each other.

The impact mode is a mode in which the motor 3 is rotated only in one direction for causing the hammer 42 to strike the anvil 52. At the impact mode, the operating section 46B is in a state shown in FIG. 9, where the hammer 42 is movable rearward and the switch 23A and the protruding section 45B are not in contact with each other. In the impact mode, although a fastener can be driven with a large torque compared with the electronic pulse mode, noise at fastening work is large. This is because, when the hammer 42 strikes the anvil 52, the hammer 42 strikes the anvil 52 while being urged forward by the urging spring 43, and thus the anvil 52 receives not only impacts in the rotational direction but also impacts in the front-rear direction (the axial direction), which causes these impacts in the axial direction to reverberate via a workpiece. Hence, the impact mode is mainly used when work is done outdoor and when a large torque is needed.

Specifically, in the impact mode, when the motor 3 rotates, the rotation is transmitted to the hammer 42 via the gear mechanism 41. Thus, the anvil 52 rotates together with the hammer 42. As fastening work proceeds and when the torque of the anvil 52 becomes greater than or equal to the predetermined value, the hammer 42 moves rearward against the urging force of the urging spring 43. At this time, an elastic energy is stored in the urging spring 43. Then, at a moment when the first engaging protrusion 42A rides over the first engaged protrusion 52A and the second engaging protrusion 42B rides over the second engaged protrusion 52B, the elastic energy stored in the urging spring 43 is released, thereby causing the first engaging protrusion 42A to collide with the second engaged protrusion 52B and, at the same time, causing the first engaging protrusion 42A to collide with the first engaged protrusion 52A. With such configuration, the rotational force of the motor 3 is transmitted to the anvil 52 as a striking force. Note that the user can recognize by the positions of the protruding section 45B and the operating section 46B that the impact mode is set. In the present embodiment, if the impact mode is set, the LED 26B is not turned on. Hence, that the user can also recognize by this feature that the impact mode is set.

The electronic pulse mode is a mode in which the rotational speed and the rotational direction (forward or reverse) of the motor 3 is controlled. At the electronic pulse mode, the operating section 46B is in a state shown in FIG. 1 where the hammer 42 is not movable in the front-rear direction and the switch 23A and the protruding section 45B are in contact with each other. In the electronic pulse mode, since the hammer 42 is rotated in the reverse direction after colliding the anvil 52, the rotational speed of the hammer 42 is not increased as the times the hammer 42 collides the anvil 52 is increased. Therefore, in the electronic pulse mode, compared with the impact mode, torque for fastening a fastener is small, but noise during fastening work is also small. Because the hammer 42 is not movable in the front-rear direction, when the hammer 42 collides with the anvil 52, the anvil 52 receives only impacts in the rotational direction. Thus, impacts in the axial direction do not reverberate via a workpiece. Hence, the electronic pulse mode is mainly used when work is done indoor. In this way, in the impact tool 1 of the present embodiment, the above-described impact mode and electronic pulse mode can be switched easily by operating the operating section 46B, which enables that work is done in a mode suitable for a working place and required torque.

Next, five detailed modes of the electronic pulse mode will be described with reference to FIGS. 11 through 15. The electronic pulse mode further has five operation modes of a drill mode, a clutch mode, a TEKS mode, a bolt mode, and a pulse mode, which can be switched by operating the dial 27. In the descriptions provided below, starting current is not considered in determination since a sharp rise of the starting current shown in FIG. 11, for example, does not contribute to fastening of a screw or a bolt. This starting current is not considered if dead time of 20 ms (milliseconds), for example, is provided.

Figure 11:
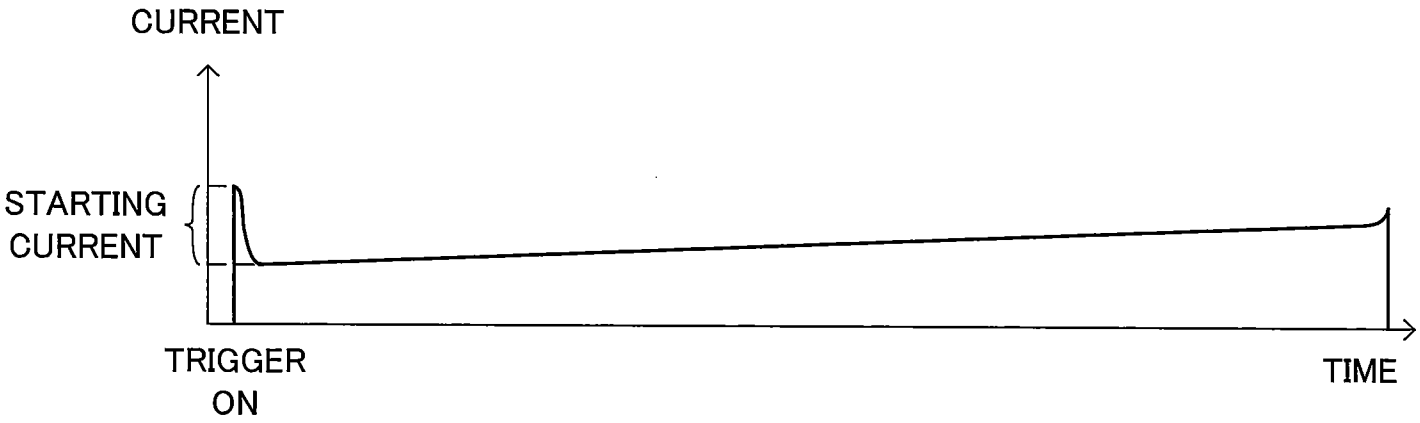
FIG. 11 is a diagram for illustrating controls of the impact tool in a drill mode according to the first embodiment of the invention.

The drill mode is a mode in which the hammer 42 and the anvil 52 keep rotating together in one direction. The drill mode is mainly used when a wood screw is driven and the like. As shown in FIG. 11, a current flowing through the motor 3 increases as fastening proceeds.

Figure 12:
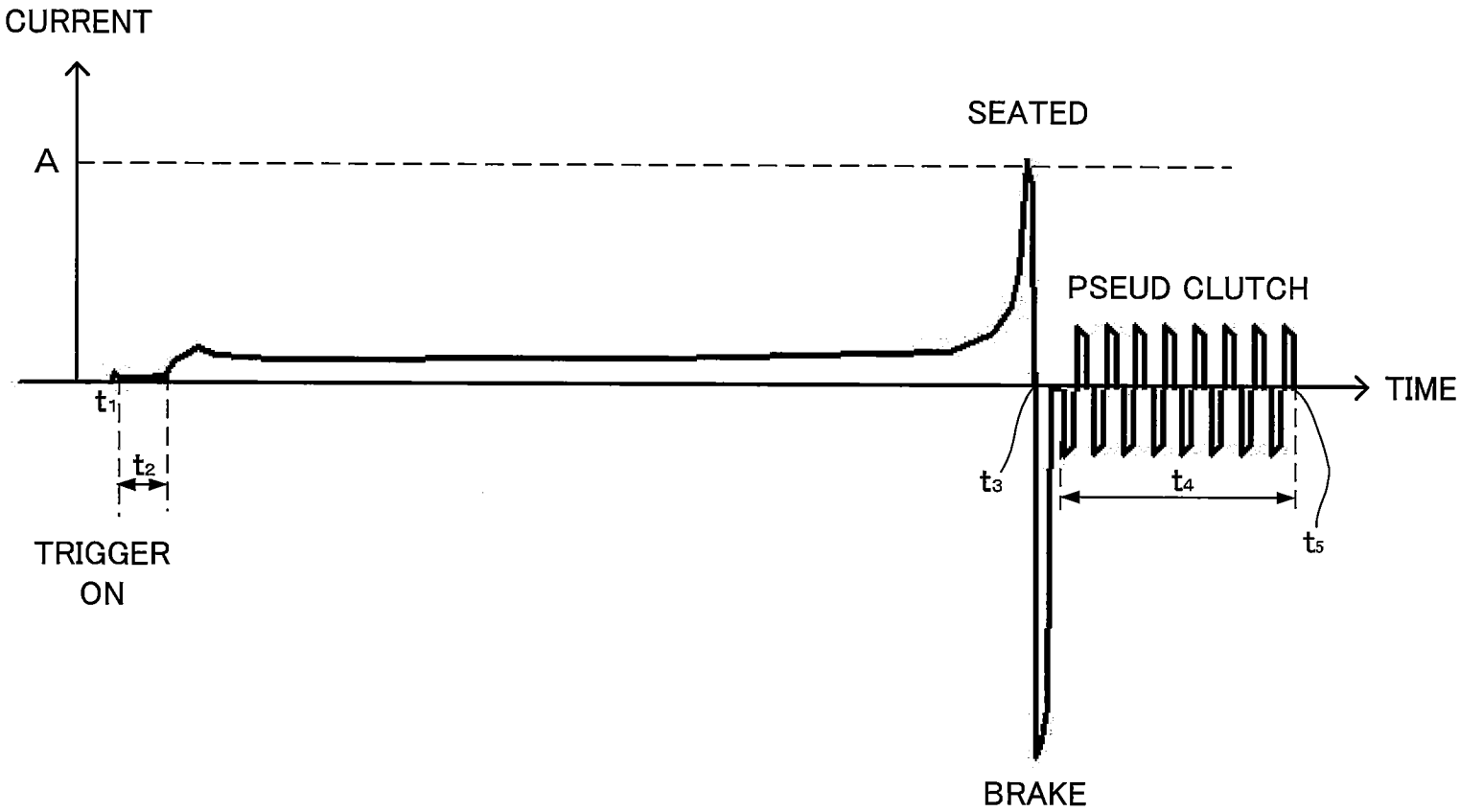
FIG. 12 is a diagram for illustrating controls of the impact tool in a clutch mode according to the first embodiment of the invention.

As shown in FIG. 12, the clutch mode is a mode in which the hammer 42 and the anvil 52 keep rotating together in one direction and, when a current flowing through the motor 3 increases to a target value (target torque), driving of the motor 3 is stopped. The clutch mode is mainly used when an accurate torque is important, such as when fastening a fastener that appears outside even after fastening is done. The target value (target torque) can be changed by the numbers of the clutch mode shown in FIG. 5.

In the clutch mode, when the trigger 25 is pulled (t1 in FIG. 12), a preliminary start is started. At the preliminary start, in order to put the hammer 42 and the anvil 52 in contact with each other, the control section 7 applies a preliminary-start voltage (for example, 1.5V) to the motor 3 for a predetermined period (t2 in FIG. 12). At a time point when the trigger 25 is pulled, there is possibility that the hammer 42 and the anvil 52 are spaced away from each other. If a current flows through the motor 3 in that state, the hammer 42 applies a striking force to the anvil 52. There is possibility that this striking force causes the hammer 42 and the anvil 52 to collide with each other, and that the target value (target torque) is reached. In the present embodiment, the preliminary start is performed to prevent collision between the hammer 42 and the anvil 52, thereby preventing a current flowing through the motor 3 from reaching the target value (target torque) instantaneously.

When a fastener is seated on a workpiece, the current value rises sharply (t3 in FIG. 12). If this current value exceeds a threshold value A, the control section 7 stops torque supply to the fastener. However, because the current value has increased sharply when a bolt is driven, torque may be supplied to the bolt due to inertia if applying of forward-rotation voltage is simply stopped. Accordingly, in order to stop torque supply to the bolt, reverse-rotation voltage for braking is applied to the motor 3.

Subsequently, the motor 3 is applied with forward-rotation voltage and reverse-rotation voltage for pseudo clutch alternately (t4 in FIG. 12). In the present embodiment, a period for applying the forward-rotation voltage and reverse-rotation voltage for pseudo clutch is set to 1000 ms (1 second). The pseudo clutch has a feature of informing the operator that a predetermined current value is reached and hence a predetermined torque is obtained. The operator is informed that the motor 3 has no output in a simulated manner, although the motor 3 actually has an output.

If the reverse-rotation voltage for pseudo clutch is applied, the hammer 42 separates from the anvil 52. If the forward-rotation voltage for pseudo clutch is applied, the hammer 42 strikes the anvil 52. However, because the forward-rotation voltage and reverse-rotation voltage for pseudo clutch is set to a voltage (for example, 2V) of a degree not applying a fastening force to a fastener, the pseudo clutch is generated merely as striking noise. Due to the generation of the pseudo clutch, the operator can recognize the end of a fastening operation. After the pseudo clutch operates for a period t4, the motor 3 stops automatically (t5 in FIG. 12).

Figure 13A:
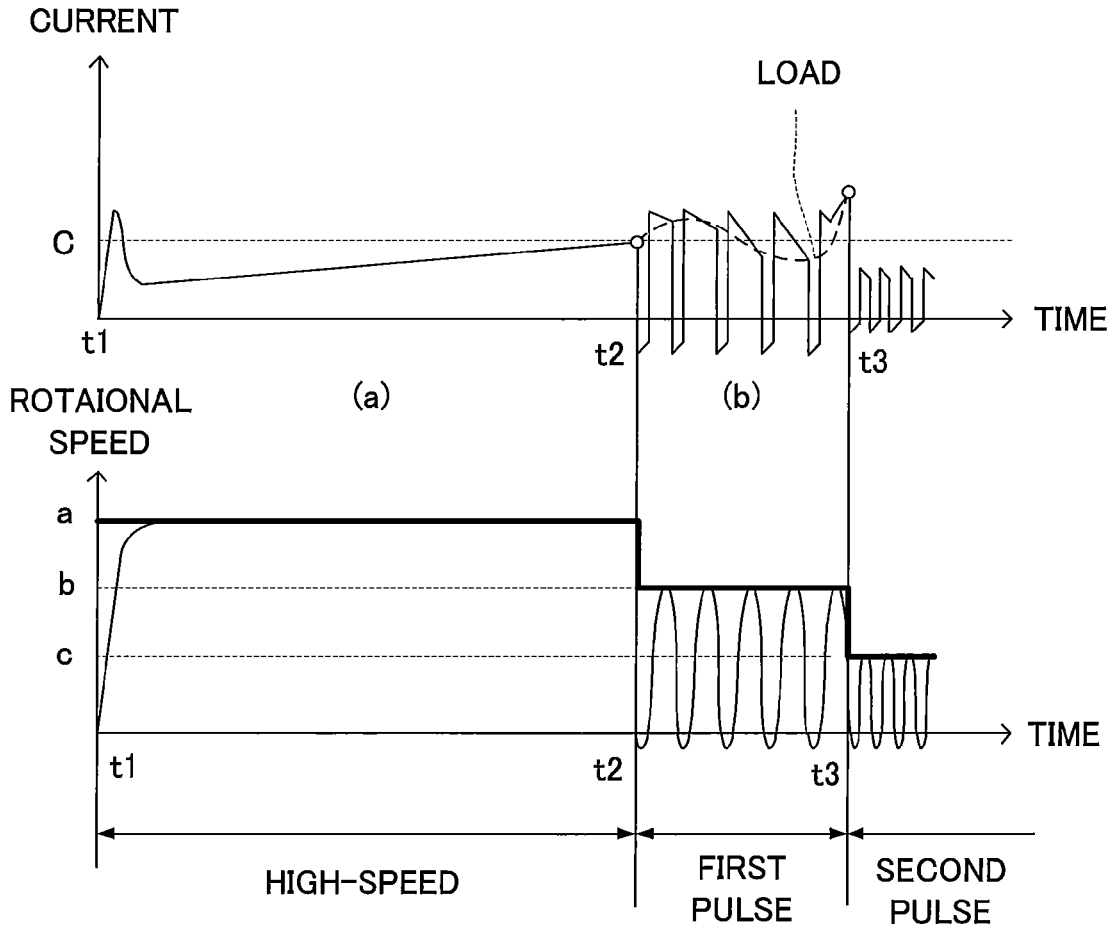
FIG. 13A is a diagram for illustrating controls of the impact tool in a TEKS mode according to the first embodiment of the invention.
Figure 13B:
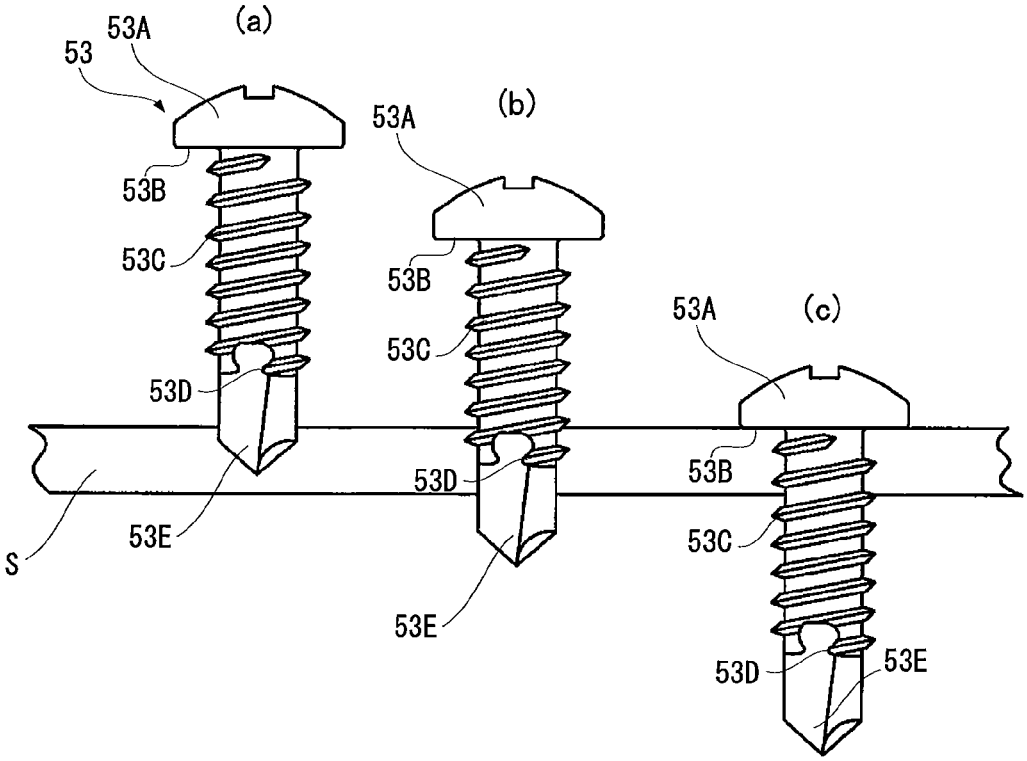
FIG. 13B is a diagram for showing positional relationship between a drill screw and a steel plate when the drill screw is driven by the impact tool in the TEKS mode according to the first embodiment of the invention.
Figure 14:
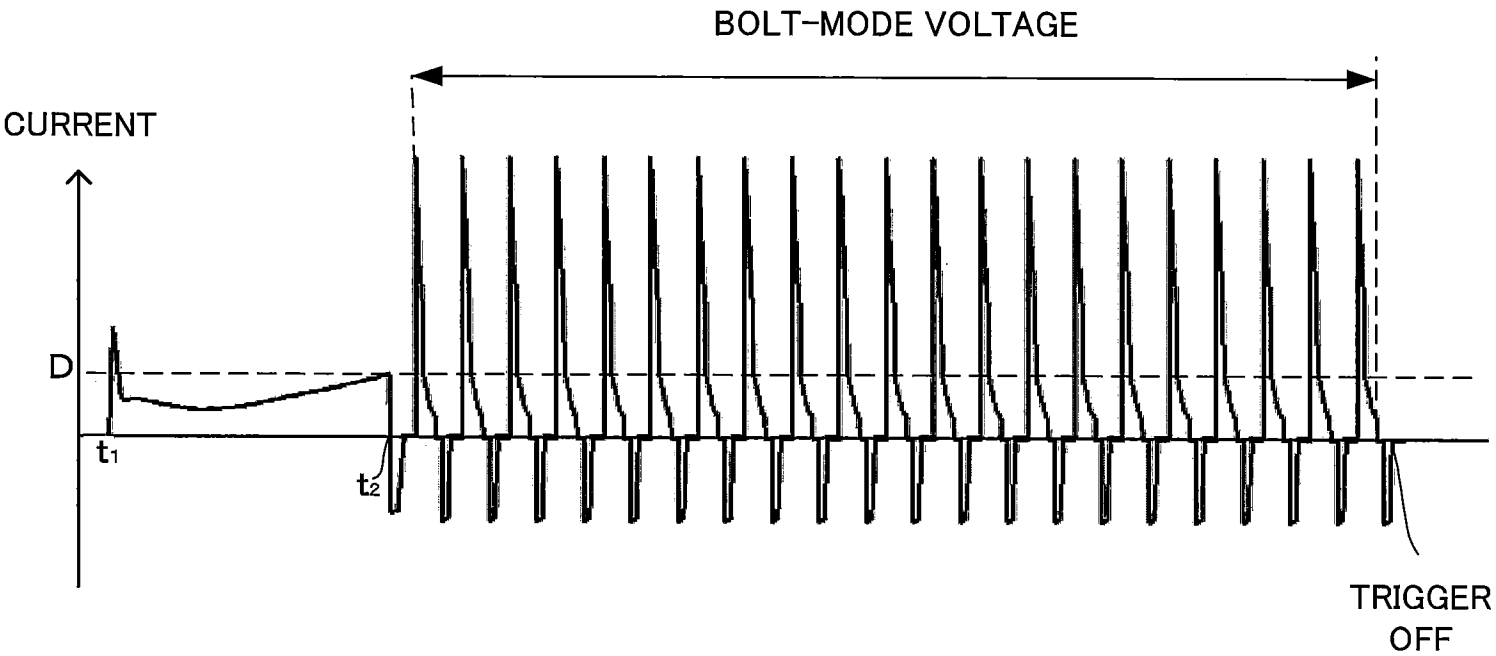
FIG. 14 is a diagram for illustrating controls of the impact tool in a bolt mode according to the first embodiment of the invention.

As shown in FIG. 13A, the TEKS mode is a mode in which, when a current flowing through the motor 3 increases to a predetermined value (predetermined torque) in a state where the hammer 42 and the anvil 52 are rotated together in one direction, forward rotation and reverse rotation of the motor 3 are switched alternately to fasten a drill screw by striking force. The TEKS mode is mainly used in a case when a fastener is fastened to a steel plate. The drill screw is a screw having drill blades at the tip end for making a hole in a steel plate. A drill screw 53 includes a screw head 53A, a seating surface 53B, a screw part 53C, a screw end 53D, and a drill 53E (FIG. 13B).

In the TEKS mode, because importance is not given to fastening with accurate torque, the preliminary start is omitted. First, in a state where the drill 53E of the drill screw 53 is in contact with a steel plate S as shown in FIG. 13B (a), it is necessary to make a pilot hole in the steel plate S with the drill 53E. Thus, the motor 3 is rotated at a high rotational speed a (for example, 17000 rpm) (FIG. 13A (a)). Then, when the tip end of the drill screw 53 digs into the steel plate S and the screw end 53D reaches the steel plate S (FIG. 13B (b)), friction between the screw part 53C and the steel plate S works as resistance and the current value increases. When the current value exceeds a threshold C (for example, 11 A (amperes)) (t2 in FIG. 13A), the mode shifts to a first pulse mode in which forward rotation and reverse rotation are repeated (FIG. 13A (b)). In the present embodiment, during the first pulse mode, the motor 3 is rotated forward at a rotational speed b (for example, 6000 rpm) lower than the rotational speed a. Then, when the seating surface 53B is seated on the steel plate S (FIG. 13B (c)), the current value rises sharply. In the present embodiment, the rate of increase in the current value exceeds a predetermined value, the mode shifts to a second pulse mode (t3 in FIG. 13A) in which forward rotation and reverse rotation are repeated. During the second pulse mode, the motor 3 is rotated forward at a rotational speed c (for example, 3000 rpm) lower than the rotational speed b. This can prevent damaging the drill screw 53 and damaging the slot in the head of the drill screw 53 due to excessive torque applied to the drill screw 53 by the bit.

The bolt mode is a mode in which, when a current flowing through the motor 3 increases to a predetermined value (predetermined torque) in a state where the hammer 42 and the anvil 52 are rotated together in one direction, forward rotation and reverse rotation of the motor 3 are switched alternately to fasten a fastener by striking force. The bolt mode is mainly used for fastening a bolt.

In the bolt mode, because importance is not given to fastening with accurate torque, an operation corresponding to the preliminary start in the clutch mode is omitted. In the bolt mode, firstly the motor 3 is rotated only in a forward direction to rotate the hammer 42 and the anvil 52 together in one direction. Then, when the current value of the motor 3 exceeds a threshold value D (t1 in FIG. 14), a bolt-mode voltage is applied to the motor 3 with a predetermined interval (t2 in FIG. 14). Application of the bolt-mode voltage causes forward rotation and reverse rotation of the anvil 52, thereby fastening a bolt. The bolt-mode voltage has a shorter period of forward rotation compared with a voltage for preventing damaging of the slot in the screw head, in order to alleviate reaction. By turning off the trigger 25, the motor 3 stops.

The pulse mode is a mode in which, when a current flowing through the motor 3 increases to a predetermined value (predetermined torque) in a state where the hammer 42 and the anvil 52 are rotated together in one direction, forward rotation and reverse rotation of the motor 3 are switched alternately to fasten a fastener by striking force. The pulse mode is mainly used for fastening an elongated screw that is used in a place that does not appear outside, and the like. With this mode, a strong fastening force can be provided, and also reaction force from a workpiece can be reduced.

However, because resistance of the fastener increases in a final phase of a fastening operation, the motor 3 outputs a larger torque, which increases reaction that occurs at striking in the impact tool 1. If reaction increases, the handle section 22 is rotatably moved in the opposite direction from the rotational direction of the motor 3 about the output shaft 31 of the motor 3, thereby worsening workability. Hence, in the present embodiment, the gyro sensor 26A built in the handle section 22 detects velocity of the handle section 22 in the circumferential direction about the output shaft 31, that is, magnitude of reaction that is generated in the impact tool 1. If detection velocity by the gyro sensor 26A becomes greater than or equal to a threshold value a described later, the motor 3 is rotated in reverse direction in order to suppress reaction.

Note that the gyro sensor 26A is also called as a gyroscope, and is a measurement instrument for measuring angular velocity of an object.

Figure 15:
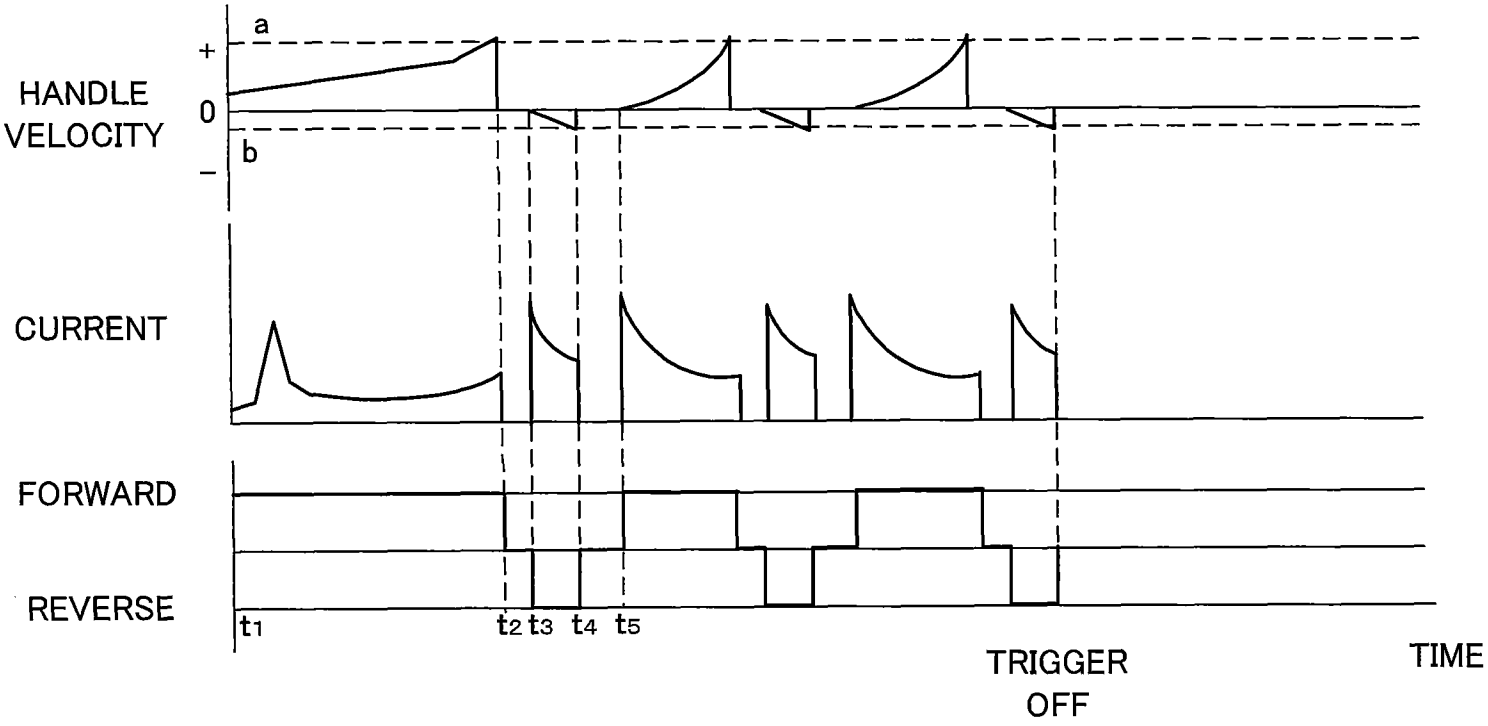
FIG. 15 is a diagram for illustrating controls of the impact tool in a pulse mode according to the first embodiment of the invention.

The operation in the pulse mode according to the present embodiment will be described with reference to FIGS. 15 and 16. In the pulse mode, too, an operation corresponding to a preliminary start is omitted.

Figure 16:
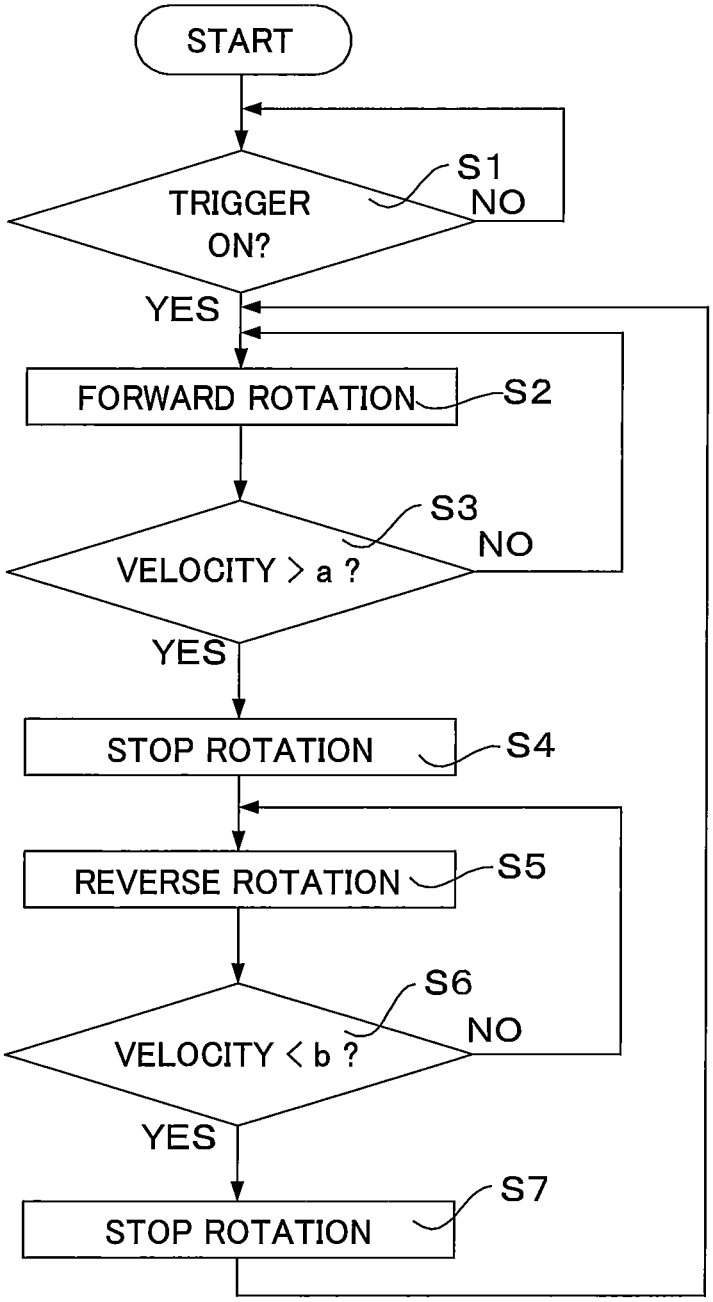
FIG. 16 is a flowchart showing controls of the impact tool in the pulse mode according to the first embodiment of the invention.

In the flowchart of FIG. 16, the control section 7 first determines whether the trigger 25 is pulled (S1). If the trigger 25 is pulled (t1 in FIG. 15, S1: YES), the control section 7 starts forward rotation of the motor 3 (S2). Next, the control section 7 determines whether velocity of the gyro sensor 26A exceeds a threshold value a (8 m/s (meter/second) in the present embodiment) (S3). If the velocity exceeds the threshold value a (t2 in FIG. 15, S3: YES), the control section 7 stops the motor 3 for a predetermined period (S4), and subsequently starts reverse rotation of the motor 3 (t3 in FIG. 15, S5). Next, the control section 7 determines whether the velocity of the gyro sensor 26A falls below a threshold value b (3 m/s in the present embodiment) (S6). If the velocity falls below the threshold value b (t4 in FIG. 15, S6: YES), the control section 7 stops the motor 3 for a predetermined period (S7), and subsequently returns to S1 to restart forward rotation of the motor 3 (t5 and thereafter in FIG. 15).

According to this configuration, because the motor 3 is rotated reversely when the velocity of the gyro sensor 26A exceeds the threshold value a, reaction generated in the impact tool 1 can be suppressed. Further, one can conceive a control method of switching from forward rotation to reverse rotation when the current value of the motor 3 exceeds a predetermined value. In such a control, however, a fastening force becomes weak when the predetermined value is small, whereas large reaction is generated when the predetermined value is large. In contrast, in the present embodiment, when the output of the gyro sensor 26A exceeds the threshold value a, it is determined that an acceptable range of reaction is exceeded, and the motor 3 is rotated reversely. Hence, a maximum fastening force can be obtained within the acceptable range of reaction.

Next, controls of the motor 3 according to the pulled amount of the trigger 25, which are common in all the operation modes in the electronic pulse mode, will be described with reference to FIGS. 17 and 18.

Normally, the trigger 25 is so configured that, as the pulled amount is larger, the duty of PWM signal outputted to the inverter circuit 6 becomes larger. However, if a thin sheet is affixed to a surface layer of a workpiece, there is possibility that the thin sheet is broken at a moment when a fastener is seated on the workpiece. In order to prevent this, the operator changes an electric driver to a manual drive just before a fastener is seated on a workpiece, so that he can fasten the fastener manually, which worsens workability. Thus, in the impact tool 1 of the present embodiment, PWM signal with a constant duty such that the torque of the motor 3 is substantially identical to torque of the fastener is outputted to the inverter circuit 6 when the pulled amount of the trigger 25 is in a predetermined zone, thereby enabling the impact tool 1 to be used to fasten the fastener manually.

Figure 17A:
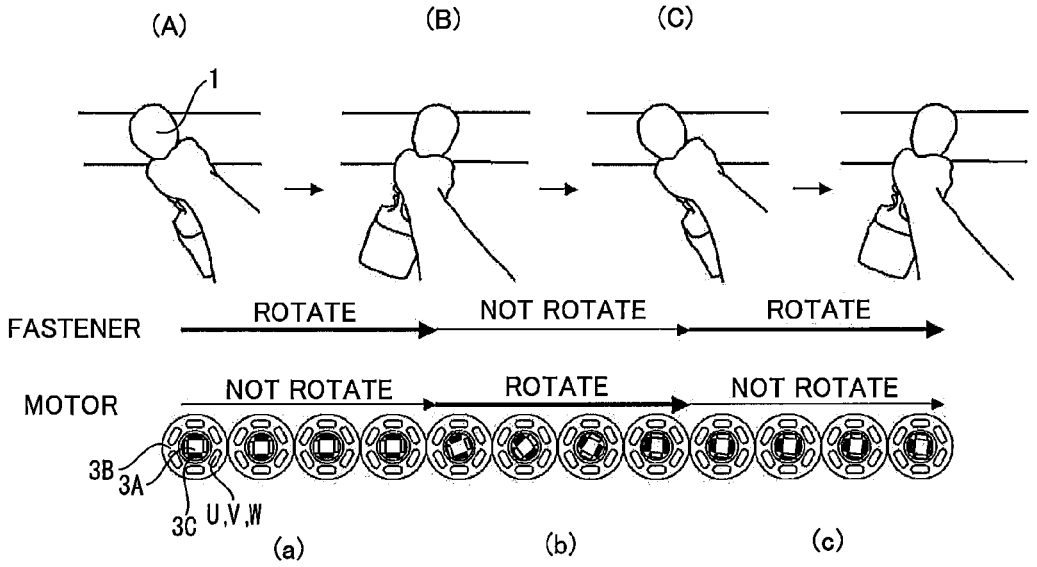
FIG. 17A is a diagram for illustrating relevance between a pulled amount of a trigger and controls of a motor of the impact tool in the pulse mode according to the first embodiment of the invention.
Figure 17B:
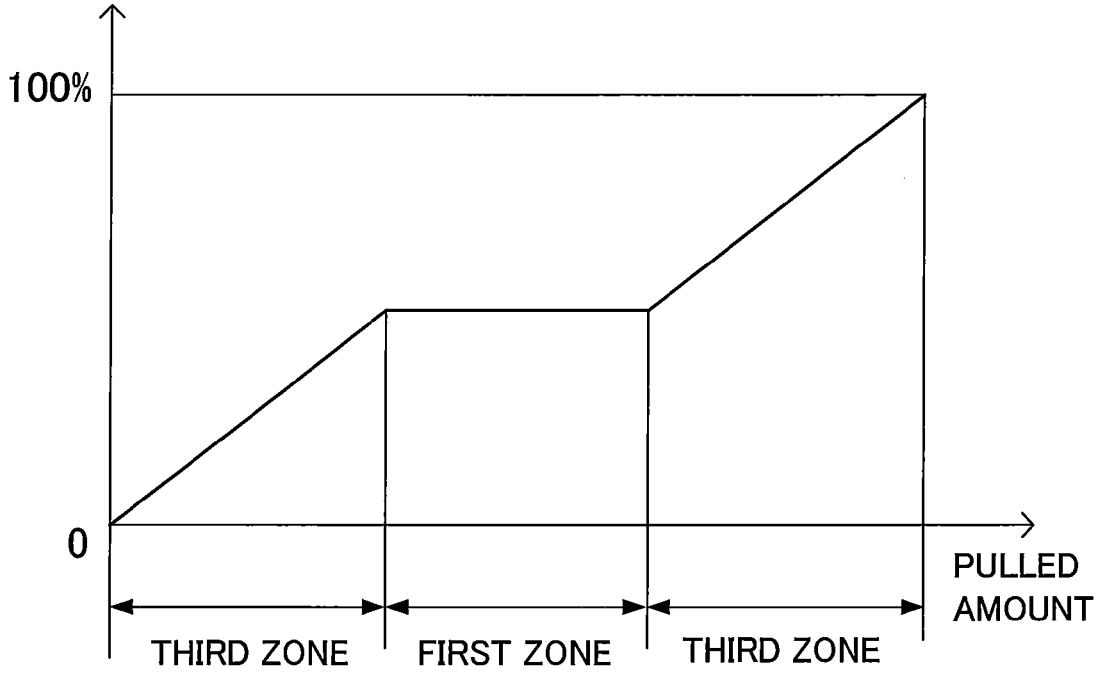
FIG. 17B is a diagram for illustrating relevance between the pulling amount of the trigger and PWM duty of the impact tool in the pulse mode according to the first embodiment of the invention.

FIG. 17A is a diagram for illustrating relevance between the pulled amount of the trigger 25 and controls of the motor 3 of the impact tool 1. FIG. 17B is a diagram for illustrating relevance between the pulling amount of the trigger 25 and PWM duty of the impact tool 1. As to the pulled amount of the trigger 25, a first zone, a second zone (not shown in FIG. 17B), and a third zone are provided. The first zone and the second zone are provided between the two third zones. The third zone is a zone in which conventional controls are performed. The first zone is obtained by pulling the trigger 25 by a predetermined amount from the third zone. The first zone is a zone in which the torque of the motor 3 is substantially identical to torque of the fastener. The second zone is obtained by pulling the trigger 25 further slightly from the first zone.

When the pulled amount of the trigger 25 is in the first zone, torque of the motor 3 is constant. It is supposed that the torque of the fastener just before the fastener is seated on a workpiece falls into a range between 5-40 N·m. Therefore, in the present embodiment, the torque of the motor 3 is set to the value falling into the above range. When the operator rotates the impact tool 1 about the output shaft 31 with the torque of the motor 3 having the value falling into the above range, the motor 3 rotates with the rotation of the impact tool 1 since the torque of the motor 3 is substantially identical to torque of the fastener. Thus, when the torque of the motor 3 is set to the value falling into the above range, the operator can manually fasten the fastener (FIG. 17A (a)) even if the torque of the motor 3 and the torque of the fastener are not identical to one another accurately.

However, when the fastener is fastened to a certain degree, the impact tool 1 is moved to a position where it is difficult to rotate the fastener manually (FIG. 17A (b)). Here, in the present embodiment, the motor 3 is rotated reversely in a low speed in the second zone where the trigger 25 is pulled slightly from the first zone. If the operator pulls the trigger 25 further slightly in a state shown in FIG. 17A (b) by rotatably moving the impact tool 1 manually, the pulled amount of the trigger 25 goes into the second zone and the motor 3 rotates reversely at a low speed. At this time, if the operator rotatably moves the impact tool 1 reversely about the output shaft 31 at a speed substantially identical to the speed of the motor 3, the position of the impact tool 1 can be returned to a state shown in FIG. 17A (c) without rotating the fastener (FIG. 17A (e)). A holding mechanism for holding the pulled amount of the trigger 25 in the second zone may be provided to easily hole the pulled amount of the trigger 25 in the second zone. Then, by returning the pulled amount of the trigger 25 to the first zone, the torque of the motor 3 becomes constant again, which allows a fastener to be fastened manually (FIG. 17A (c)). In this way, in the impact tool 1 according to the present embodiment, by adjusting the pulled amount of the trigger 25, the impact tool 1 can be used like a ratchet wrench. Further, setting torque (duty ratio) of the first zone can be changed by a dial (not shown). Hence, a fastening operation can be performed with torque that is appropriate for hardness of a workpiece.

Figure 18:
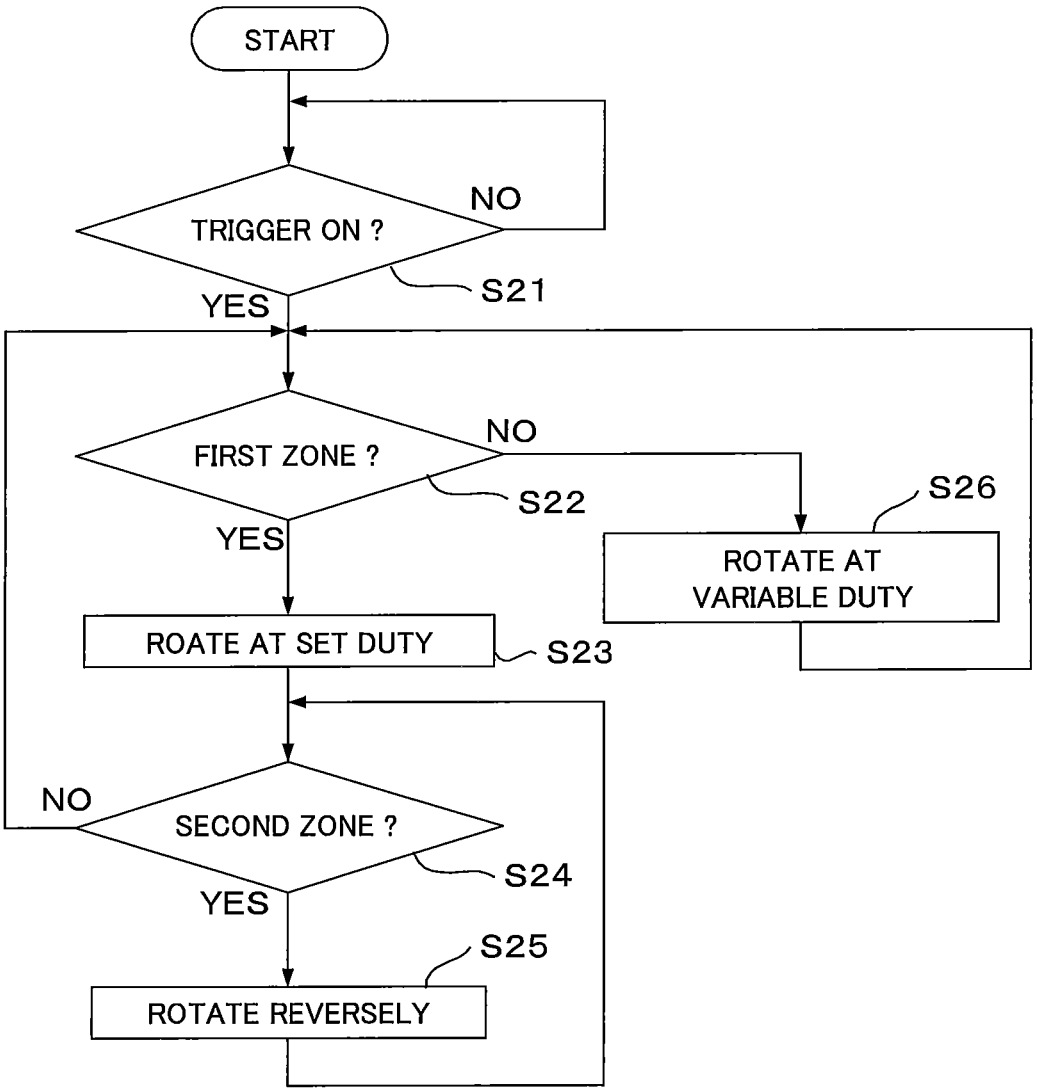
FIG. 18 is a flowchart showing controls of the motor depending on the pulling amount of the trigger of the impact tool in the pulse mode according to the first embodiment of the invention.

FIG. 18 is a flowchart showing controls of the motor 3 depending on the pulling amount of the trigger 25. The flowchart of FIG. 18 starts when the battery 24 is mounted. First, the control section 7 determines whether the trigger 25 is turned on (S21). If the trigger 25 is turned on (S21: YES), the control section 7 determines whether the pulled amount of the trigger 25 is within the first zone (S22). If the pulled amount of the trigger 25 is not within the first zone (S22: NO), the control section 7 drives the motor 3 at a duty ratio corresponding to the pulled amount of the trigger 25 (S26) and returns to S22. If the pulled amount of the trigger 25 is within the first zone (S22: YES), the control section 7 drives the motor 3 at a setting duty ratio that is set preliminarily (S23), and subsequently determines whether the pulled amount of the trigger 25 is within the second zone (S24). If the pulled amount of the trigger 25 is not within the second zone (S24: NO), the control section 7 returns to S22 again. If the pulled amount of the trigger 25 is within the second zone (S24: YES), the motor 3 rotates reversely in a low speed (S25) and the control section 7 returns to S24.

According to this configuration, even when a fastener is fastened to a workpiece of which surface layer is affixed with a thin sheet, it is not necessary to change to a manual tool such as a driver when the fastener is seated on the workpiece, and the fastener can be manually fastened only by an operation of the trigger 25, which improves workability. Note that, in the present embodiment, the impact tool 1 can be used like a ratchet wrench by reversely rotating the motor 3 in the second zone. Even if such configuration is not used, the operator may adjust the trigger 25 finely to obtain similar effects.

Next, the configuration of an impact tool 201 according to a second embodiment of the invention will be described while referring to FIG. 19. Here, parts and components identical to those in the first embodiment are designated by the same reference numerals to avoid duplicating description. In the first embodiment, when a fastener is fastened manually, the pulled amount of the trigger 25 is adjusted. In the second embodiment, a manual fastening operation can be achieved by electrically locking the motor 3 for a predetermined period after turning off the trigger 25.

Figure 19:
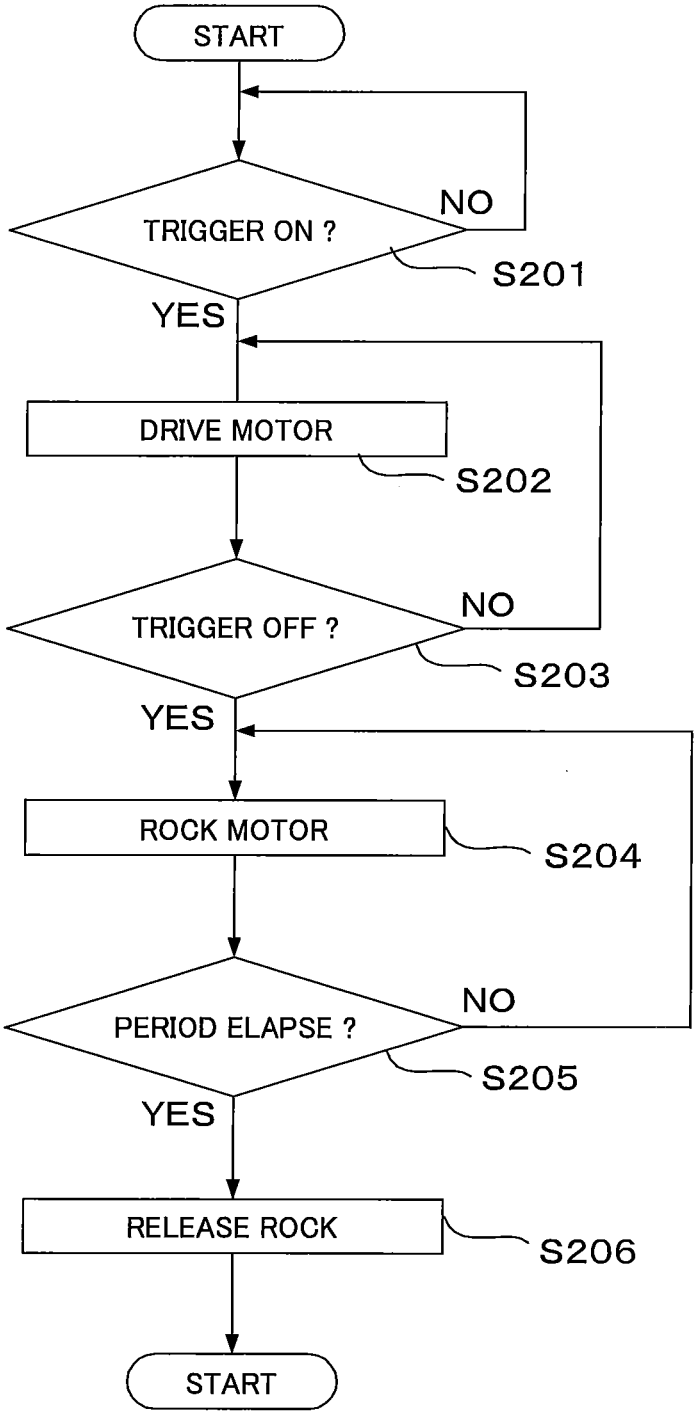
FIG. 19 is a flowchart showing controls of an impact tool when a trigger is off, according to a second embodiment of the invention.

FIG. 19 is a flowchart showing controls according to the second embodiment. The flowchart shown in FIG. 19 starts when the battery 24 is mounted. First, the control section 7 determines whether the trigger 25 is turned on (S201). If the trigger 25 is turned on (S201: YES), the control section 7 drives the motor 3 in accordance with the mode that is set (S202), and subsequently determines whether the trigger 25 is turned off (S203). Here, turning off the trigger 25 includes an automatic stop of the motor 3 during the clutch mode (t5 in FIG. 12). If the trigger 25 is turned off (S203: YES), the control section 7 locks the motor 3 (S204). Specifically, as shown in FIG. 6, the control section 7 controls currents flowing through the stator windings U, V, and W so that one stator winding comes to a position in confrontation with one permanent magnet 3C and that another stator winding opposed to the one stator winding comes to a position in confrontation with another permanent magnet 3C opposed to the one permanent magnet 3C. At this time, the electrical power is supplied to the stator winding at 100% in order to fix the motor. With this operation, the motor 3 is electrically locked. Subsequently, the control section 7 determines whether a predetermined period has elapsed after the trigger 25 is turned off (S203: YES) (S205). If the predetermined period has not elapsed (S205: NO), the control section 7 returns to S204. If the predetermined period has elapsed (S205: YES), the motor 3 is released from locking (S206).

With such configuration, the operator can fasten a fastener manually simply by turning off the trigger 25.

Next, the configuration of an impact tool 301 according to a third embodiment of the invention will be described while referring to FIGS. 20 and 21. Here, parts and components identical to those in the first and second embodiments are designated by the same reference numerals to avoid duplicating description. In the second embodiment, the motor 3 is electrically locked for a predetermined period after the trigger 25 is turned off. In the third embodiment, after the trigger 25 is turned off, controls are performed to detect rotation of the motor 3 and to prevent rotation.

Figure 20:
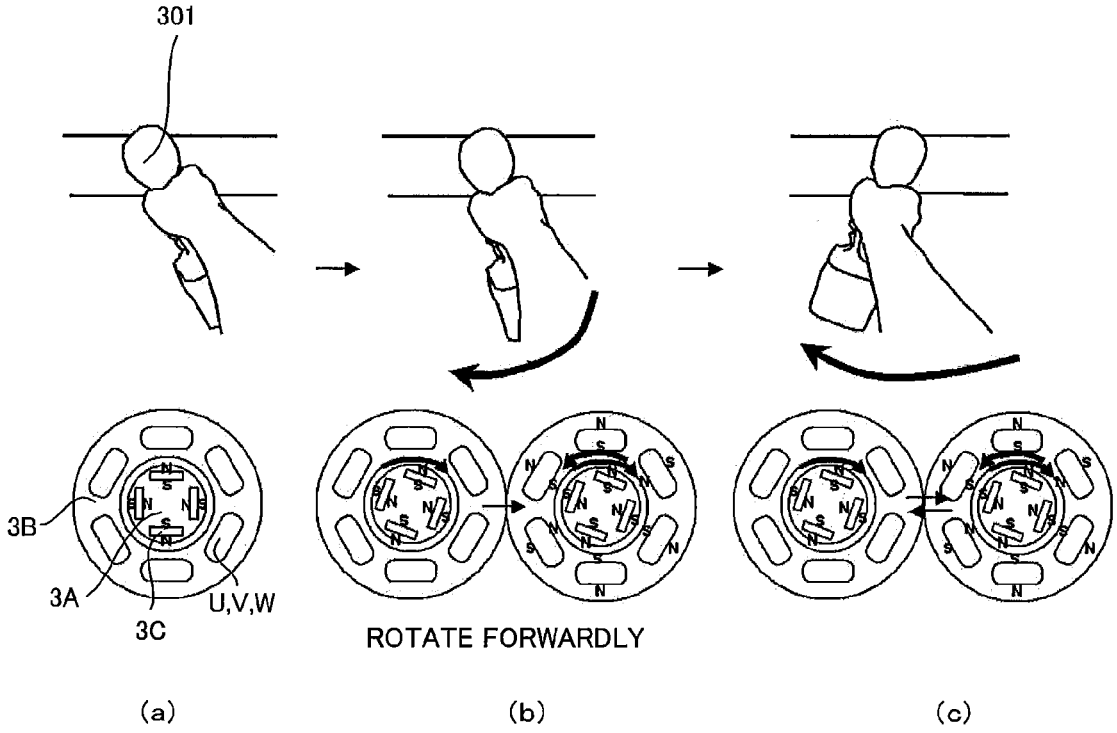
FIG. 20 is a diagram for illustrating rotation of a motor of an impact tool when a trigger is off, according to a third embodiment of the invention.

FIG. 20 is a diagram for illustrating rotation of the motor 3 when the trigger 25 is off FIG. 20(*a*) shows a state in which the trigger 25 is turned off after the trigger 25 is turned on, and the motor 3 is stopped. Even if the impact tool 301 is rotatably moved in the forward rotation in this state as shown in FIG. 20(*b*), the rotor 3A rotates very little because the motor 3 is stopped. However, it can be considered as viewed from the handle section 22 that the rotor 3A rotates in the reverse direction. Hence, in the present embodiment, this rotation is detected and the motor 3 is supplied with a current that rotates the rotor 3A in the direction preventing rotation, that is, in the forward direction. Further, as shown in FIG. 20(*c*), while the handle section 22 is rotatably moved, turning on and off of the motor 3 is repeated to maintain a state in which both torques are matched. Thus, by supplying currents in the stator windings U, V, and W, torque for rotating the rotor 3A and reaction force from the fastener are matched, which creates a state in which the rotor 3A does not rotate relative to the handle section 22. Hence, the operator can fasten the fastener manually by rotatably moving the handle section 22.

Figure 21:
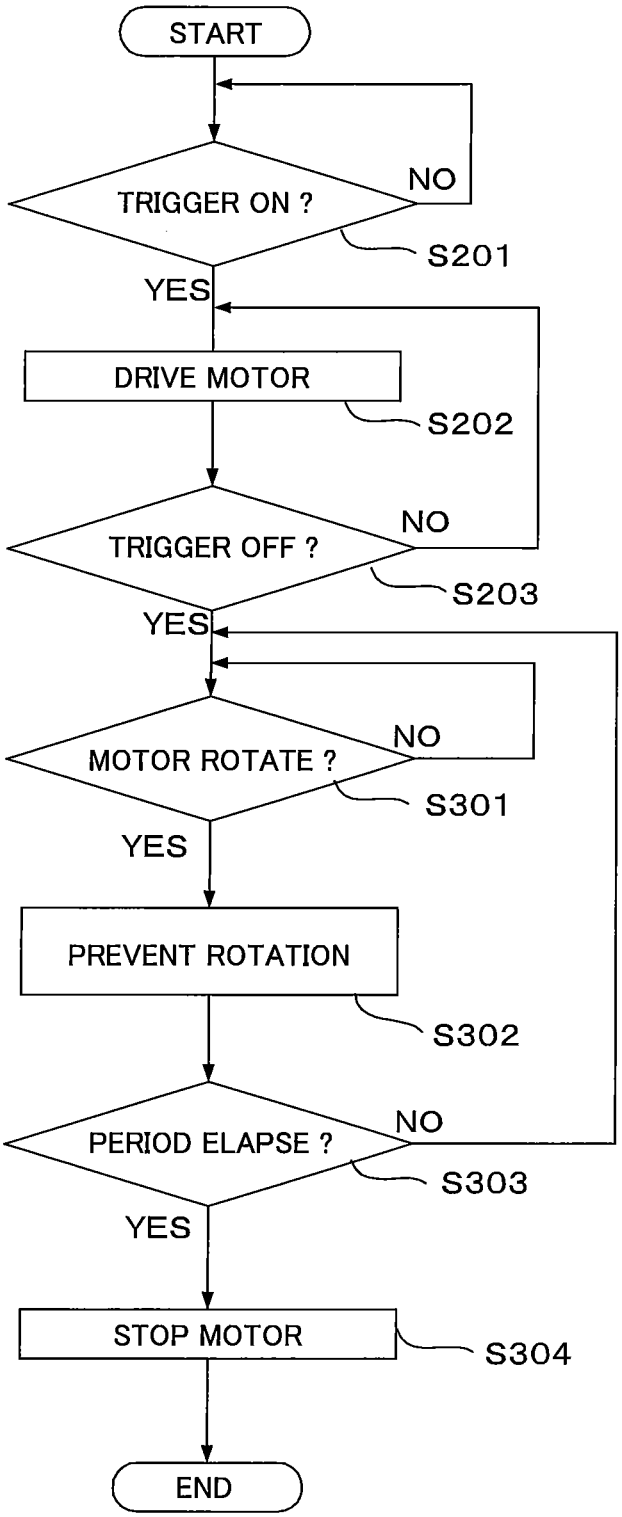
FIG. 21 is a flowchart showing controls of the impact tool when a trigger is off, according to the third embodiment of the invention.

FIG. 21 is a flowchart showing controls according to the third embodiment. The flowchart shown in FIG. 21 starts when the battery 24 is mounted. First, the control section 7 determines whether the trigger 25 is turned on (S201). If the trigger 25 is turned on (S201: YES), the control section 7 drives the motor 3 in accordance with the mode that is set (S202), and subsequently determines whether the trigger 25 is turned off (S203). If the trigger 25 is turned off (S203: YES), the control section 7 determines whether the motor 3 is rotated by signals from the rotational-position detecting elements 33A (S301). If the motor 3 is rotated (S301: YES), the control section 7 supplies the motor 3 with a current that prevents rotation (S302). Specifically, as shown in FIGS. 20(*b*) and (*c*), the control section 7 controls currents flowing through the stator windings U, V, and W so that the south pole comes to a position in confrontation with the north pole of the permanent magnet 3C and that the north pole comes to a position in confrontation with the south pole of the permanent magnet 3C. Subsequently, the control section 7 determines whether a predetermined period has elapsed after the trigger 25 is turned off at S203 (S303). If the predetermined period has not elapsed (S303: NO), the control section 7 returns to S301. If the predetermined period has elapsed (S303: YES), the motor 3 is stopped (S304).

Next, the configuration of an impact tool 401 according to a fourth embodiment of the invention will be described while referring to FIG. 22. Here, parts and components identical to those in the first embodiment are designated by the same reference numerals to avoid duplicating description. In the first embodiment, rotation of the motor 3 is transmitted to the spindle 41C and the hammer 42 via the gear mechanism 41. However, in the fourth embodiment, an output from a motor 403 is directly transmitted to a hammer 442 without a gear mechanism and a spindle.

With the configuration in the first embodiment, because the gear mechanism 41 is connected to the housing 2, a reaction force that occurs when the motor 3 rotates the gear mechanism 41 is generated in the impact tool 1 (the housing 2). More specifically, when the spindle 41C is rotated in one direction via the gear mechanism 41, the gear mechanism 41 generates a rotational force opposite to the one direction (reaction force) in the impact tool 1, and this rotational force causes the handle section 22 to rotatably move in the reverse direction about the axial center of the output shaft 31 of the motor 3 (reaction). In particular, in the electronic pulse mode where the hammer 42 and the spindle 41C always rotate together, the above-described reaction becomes more apparent. However, because a gear mechanism is not provided in the fourth embodiment, the above-described reaction force is transmitted softly from the permanent magnet 3C to the housing 2 via the stator 3B. Accordingly, the impact tool 401 is a power tool with less reaction force and good workability.

Further, a fastening operation can be done smoothly without reaction force, thereby reducing the number of striking pulses and suppressing power consumption.

Figure 22:
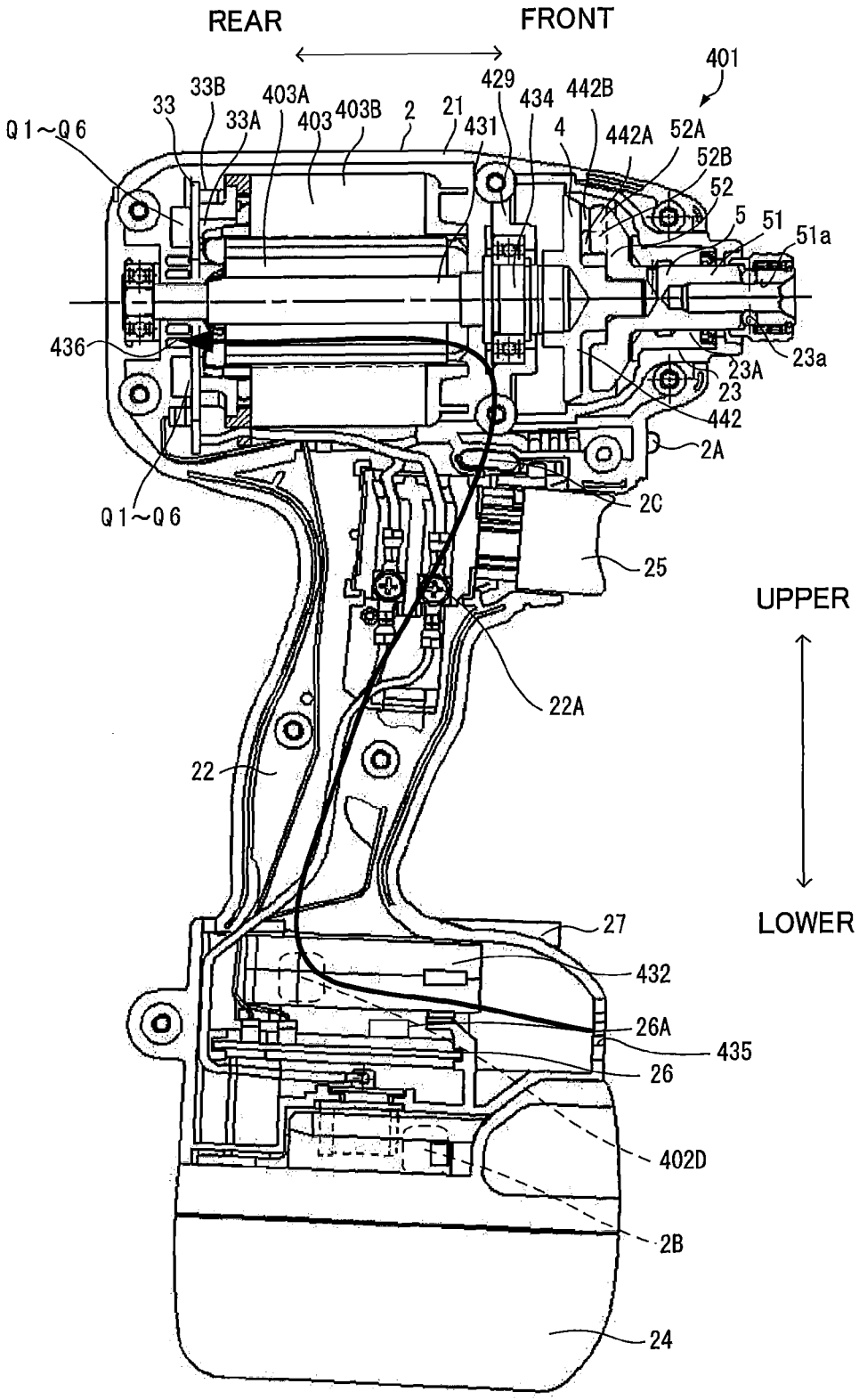
FIG. 22 is a cross-sectional view of an impact tool according to a fourth embodiment of the invention.

As shown in FIG. 22, an inner cover 429 is provided within the housing 2. The motor 403 is a brushless motor that mainly includes a rotor 403A, a stator 403B, and an output shaft 431 extending in the front-rear direction. A rod-like member 434 is provided to be rotatable coaxially at the front end of the output shaft 431. The rod-like member 434 is rotatably supported by the inner cover 429. The hammer 442 is fixed to the front end of the rod-like member 434, so that the rod-like member 434 is configured to rotate together with the hammer 442. The hammer 442 has a first engaging protrusion 442A and a second engaging protrusion 442B. The first engaging protrusion 442A and the second engaging protrusion 442B of the hammer 442 rotate together with the first engaged protrusion 52A and the second engaged protrusion 52B of the anvil 52, respectively, thereby applying a rotational force to the anvil 52. Also, the first and second engaging protrusions 442A and 442B collide with the first and second engaged protrusions 52A and 52B, respectively, thereby applying a striking force to the anvil 52.

In the present embodiment, because a gear mechanism (reducer) is not provided, the motor 403 with a low rotational speed is used. In such configuration, however, even if a fan is provided on the output shaft 431 like the first embodiment, a sufficient cooling effect cannot be obtained due to the low rotational speed. Further, in the present embodiment, because a gear mechanism (reducer) is not provided, the motor 403 with a large output torque is used. Hence, the motor 403 of the present embodiment has a larger size than the motor 3 of the first embodiment, and thus requires larger cooling capacity than the first embodiment.

Hence, in the present embodiment, a fan 432 is provided at a lower part of the handle section 22. The fan 432 is controlled to rotate regardless of rotation of the motor 403. Specifically, the fan 432 is connected to the control section 7. The control section 7 controls the fan 432 to rotate when the trigger 25 is pulled, and controls the fan 432 to stop when the trigger 25 is off. Further, in the present embodiment, an air inlet hole 435 is formed at the lower part of the handle section 22, and an air outlet hole 436 is formed at the upper part of the body section 21, so that air flows in a path indicated by the arrow in FIG. 22. With such configuration, even if the motor 403 has a low rotational speed and a large size, a sufficient cooling effect can be obtained. Further, because the fan 432 is disposed within the handle section 22, the length of the body section 21 of the impact tool 401 in the front-rear direction can be shortened.

Further, a fan switch 402D is provided at the outer frame of the handle section 22. By pressing the fan switch 402D, the fan 432 can be rotated without pulling the trigger 25. Thus, for example, when the operator is informed of a temperature rise of the motor 403 by the light 2A, the motor 403, the board 26, and the circuit board 33 can be cooled forcefully by pressing the fan switch 402D, without pulling the trigger 25.

Figure 23:
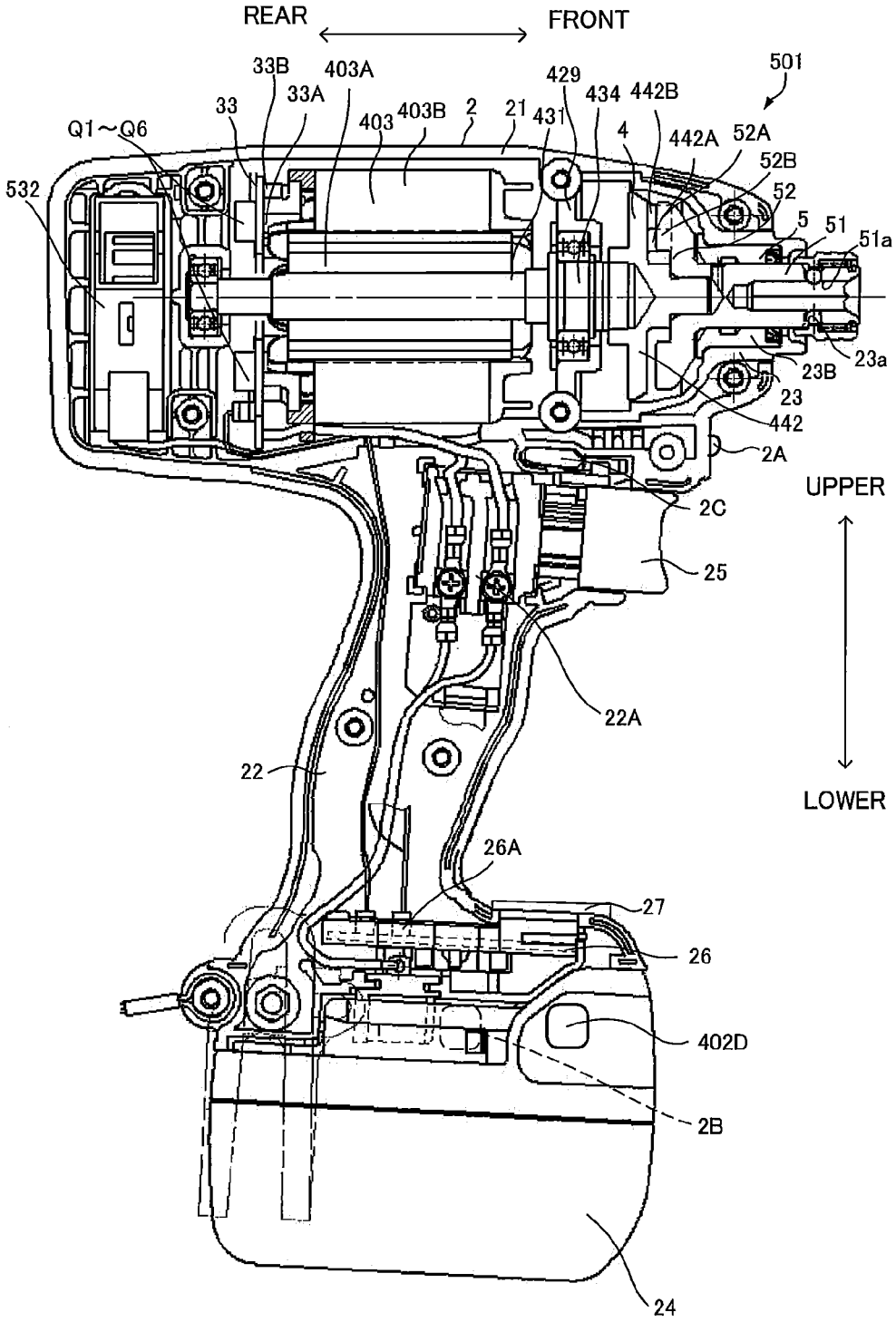
FIG. 23 is a cross-sectional view of an impact tool according to a fifth embodiment of the invention.

Next, the configuration of an impact tool 501 according to a fifth embodiment of the invention will be described while referring to FIG. 23. Here, parts and components identical to those in the first and fourth embodiments are designated by the same reference numerals to avoid duplicating description.

In the present embodiment, a fan 532 is provided at the rear side of the motor 403 within the body section 21. The fan 532 is connected to the control section 7. The control section 7 controls the fan 532 to rotate when the trigger 25 is pulled, and controls the fan 532 to stop when the trigger 25 is off Like FIGS. 1 and 2, the air inlet hole 21*b* for introducing ambient air is formed at a rear end and a rear part of the body section 21, and the air outlet hole 21*c* for discharging air is formed at a center part of the body section 21. In this way, because the fan 532 is disposed at the rear side of the motor 403, cooling air directly hits the motor 403, thereby improving cooling efficiency.

Next, the configuration of an impact tool 601 according to a sixth embodiment of the invention will be described while referring to FIGS. 24 through 26. Here, parts and components identical to those in the first embodiment are designated by the same reference numerals to avoid duplicating description.

Figure 24:
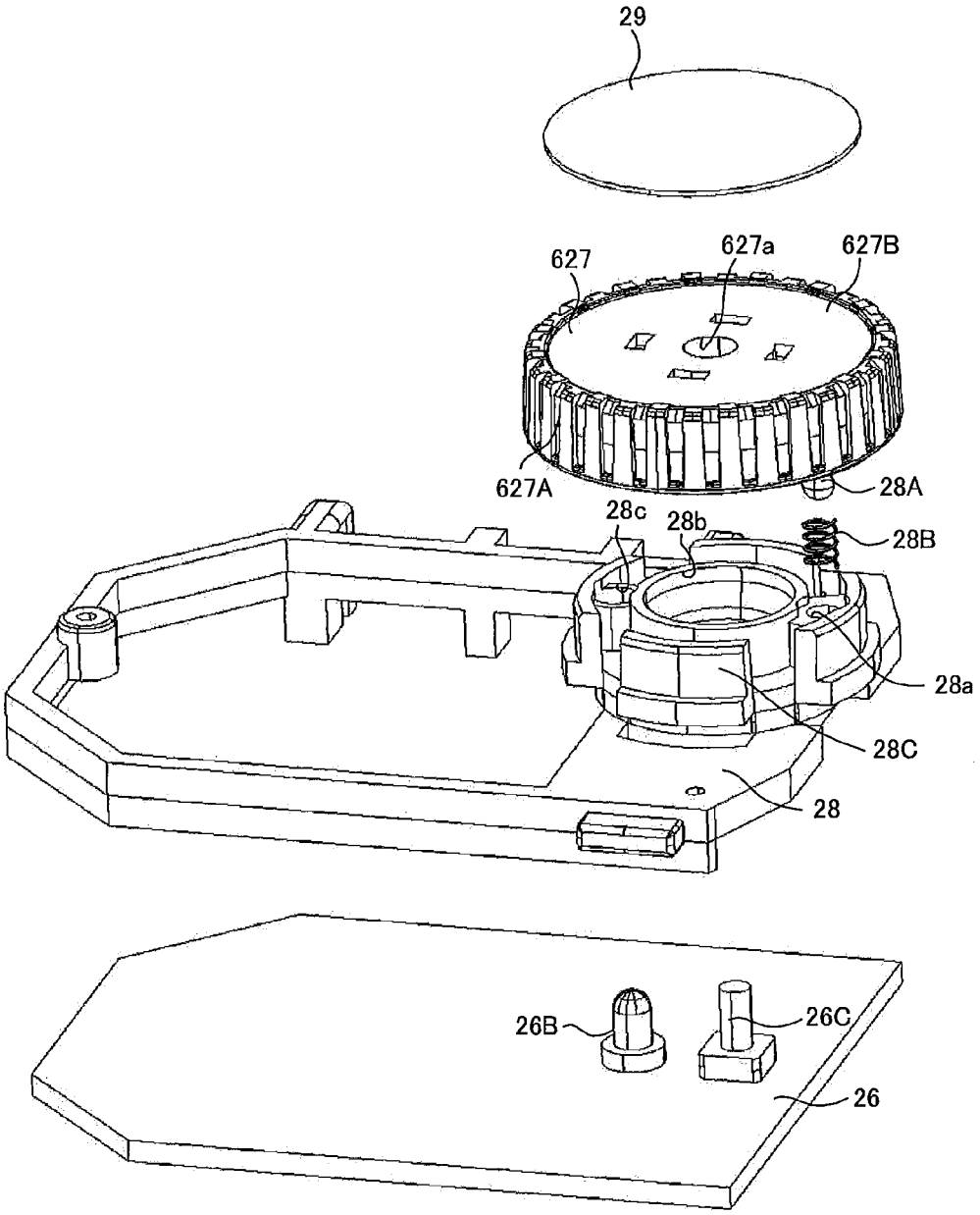
FIG. 24 is an assembly diagram showing a dial and surrounding parts of an impact tool according to a sixth embodiment of the invention.
Figure 25:
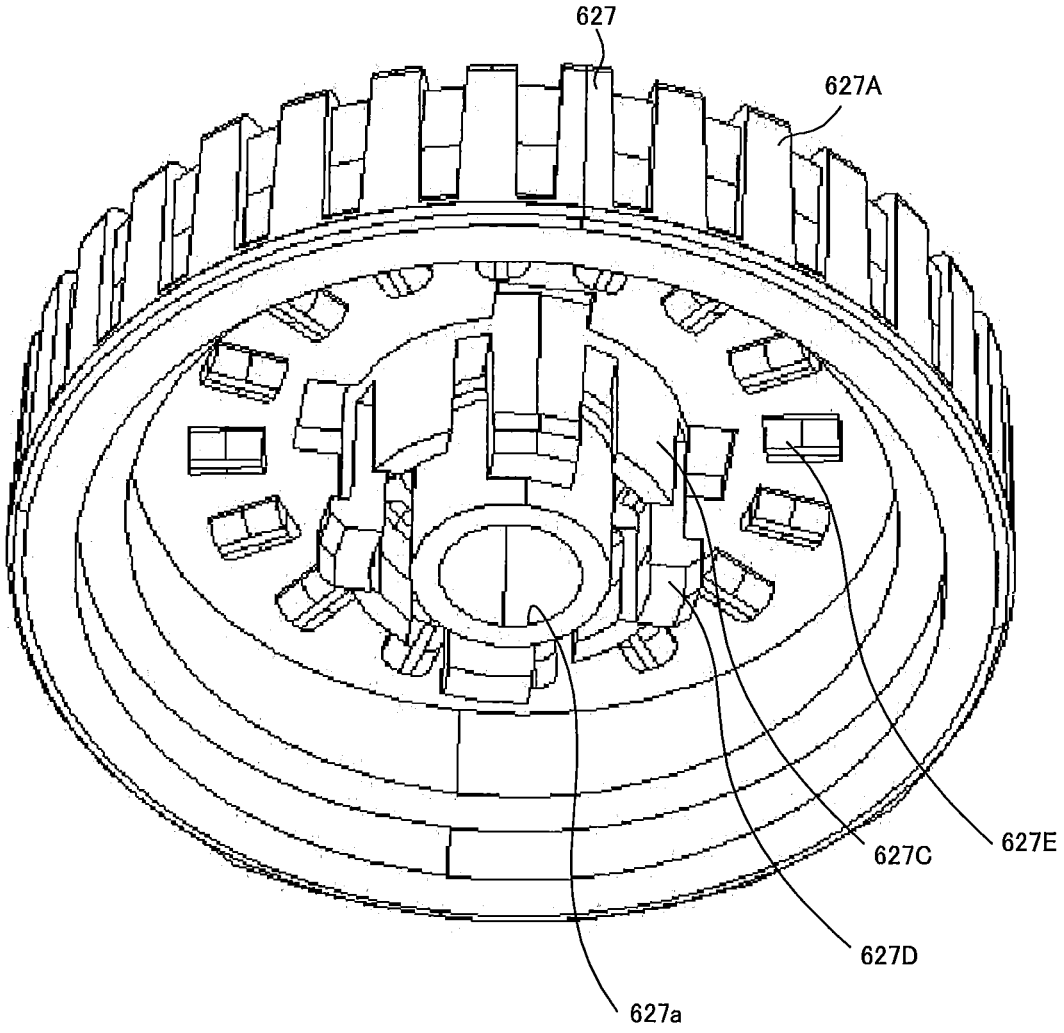
FIG. 25 is a perspective view showing the dial of the impact tool according to the sixth embodiment of the invention.
Figure 26:
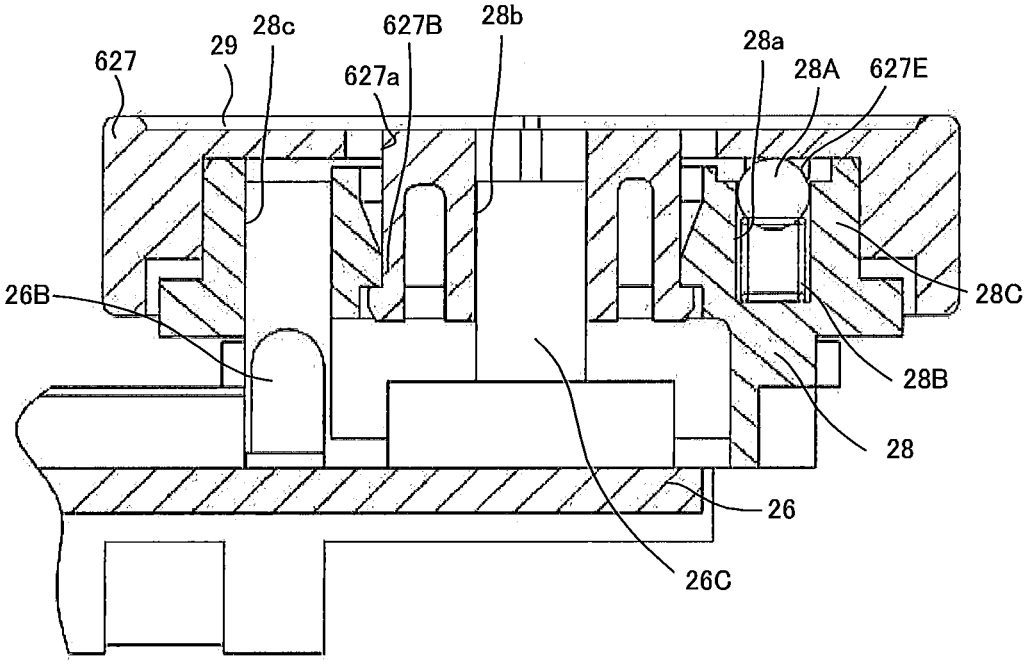
FIG. 26 is a cross-sectional view of the dial and surrounding parts of the impact tool according to the sixth embodiment of the invention.

In the present embodiment, as shown in FIGS. 24 through 26, a dial 627 is provided at the handle section 22, instead of the dial 27. A disk section 627B of the dial 627 is made of a transparent member, so that light from the LED 26B can transmit the disk section 627B and irradiate the dial seal 29 from below. A plurality of convex sections 627E is provided at the lower surface of the disk section 627B so as to protrude downward. The plurality of convex sections 627E is provided at equal intervals in a circumferential arrangement around a through hole 627*a*. As shown in FIG. 26, when the ball 28A of the dial supporting section 28 is located between the convex sections 627E, each mode in the electronic pulse mode is set.

Next, the configuration of an impact tool 701 according to a seventh embodiment of the invention will be described while referring to FIGS. 27 and 28. Here, parts and components identical to those in the first embodiment are designated by the same reference numerals to avoid duplicating description.

Figure 27:
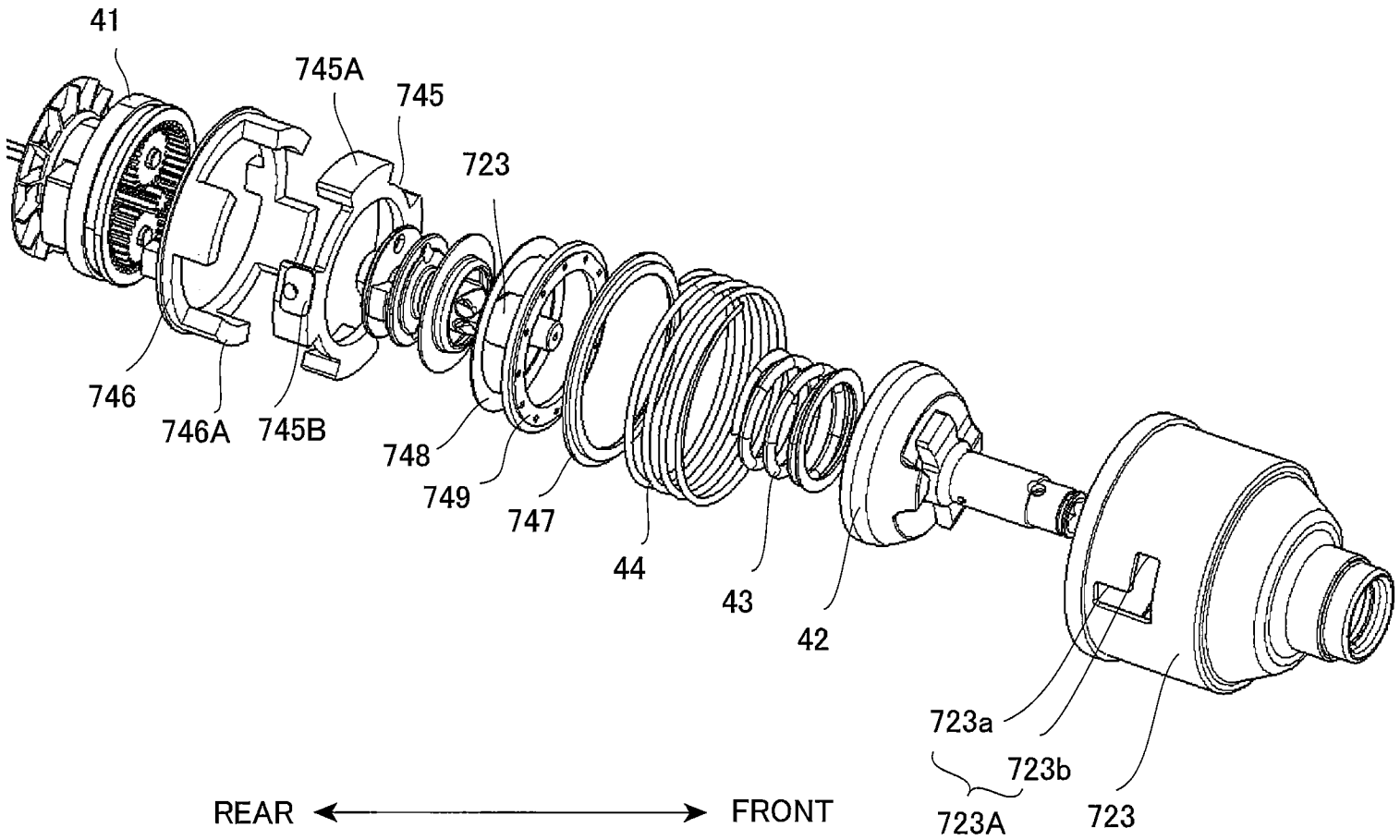
FIG. 27 is an assembly diagram showing a hammer section and surrounding parts of an impact tool according to a seventh embodiment of the invention.

As shown in FIG. 27, in the present embodiment, a first ring-shaped member 745 has four first convex sections 745A and a pair of operating sections 745B mounted on opposite convex sections 745A respectively. In other words, the pair of operating sections 745B is disposed on the first ring-shaped member 745, although the operating section 46B is disposed on the second ring-shaped member 46 in the first embodiment. Therefore, the first convex sections 745A rides on a second convex sections 746A by rotating the operating section 745B of the first ring-shaped member 745, although the first convex sections 45A ride on the second convex sections 46A by rotating the operating section 46B of the second ring-shaped member 46 in the first embodiment.

Further, in the present embodiment, a pair of guide holes 723A is formed at the rear side of a hammer case 723 with intervals of 180 degrees in the circumferential direction. Each of the pair of guide hole 723A has a first guide hole 723*a* extending in the front-rear direction and a second guide hole 723*b* extending in the circumferential direction from the front end of the first guide hole 723*a*.

In the impact mode, the operating section 745B protrudes from the rear end of the first guide hole 723*a*. On the other hands, the mode is switched to the electronic pulse mode by moving the operating section 745B to the second guide hole 723*b*, that is, forward direction and then circumferential direction. The operating section 745B cannot move between the first guide hole 723*a* and the second guide hole 723*b* without moving the circumferential direction. Therefore, the mode is prevented from being switched due to the vibration of the impact tool 701. Further, since the pair of operating sections 745B protrude from the pair of guide holes 723A respectively, it becomes easy to move the pair of operation sections 745B.

Further, in the present embodiment, washers 747 and 748 and a thrust bearing 749 are disposed between the hammer 42 and the first ring-shaped member 745. The thrust bearing 749 is made of a low frictional material. Therefore, it becomes possible to suppress the occurrence of the rotational friction between the hammer 42 and the first ring-shaped member 745 when the hammer 42 is moved rearward.

Figure 28:
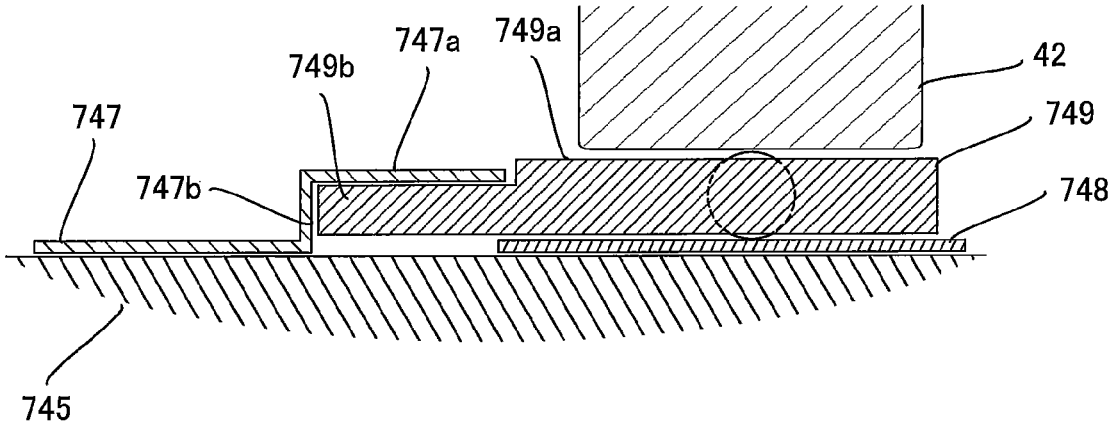
FIG. 28 is a partial cross-sectional view of a washer and a bearing of the impact tool according to the seventh embodiment of the invention.

Further, as shown in FIG. 28, the washer 747 has a protruding part 747*a*, and a space 747*b* is formed between the protruding part 747*a* and the washer 748. Further, the thrust bearing 749 has a ball part 749*a* and an end part 749*b*. The end part 749*b* is disposed in the space 747*b*. The distance of the space 747*b* in the upper-lower direction in FIG. 28 is slightly longer than the total thicknesses of the washer 748 and the end part 749*b*. Therefore, it becomes possible to suppress the occurrence of the rotational friction between the protruding part 747*a* and the end part 749*b* when the hammer 42 is moved rearward.

Note that a resin sheet having a low frictional property such as fluoric resin may be used instead of the thrust bearing 749.

Next, the configuration of an impact tool 801 according to an eighth embodiment of the invention will be described while referring to FIGS. 29 through 33. Here, parts and components identical to those in the first embodiment are designated by the same reference numerals to avoid duplicating description.

In the above embodiments, the electronic pulse mode is achieved by fixing the hammer 42 in the forward-rearward direction. However, in the present embodiment, the electronic pulse mode is achieved by only the control of the motor 3 without fixing the hammer 42 in the forward-rearward direction.

Figure 29:
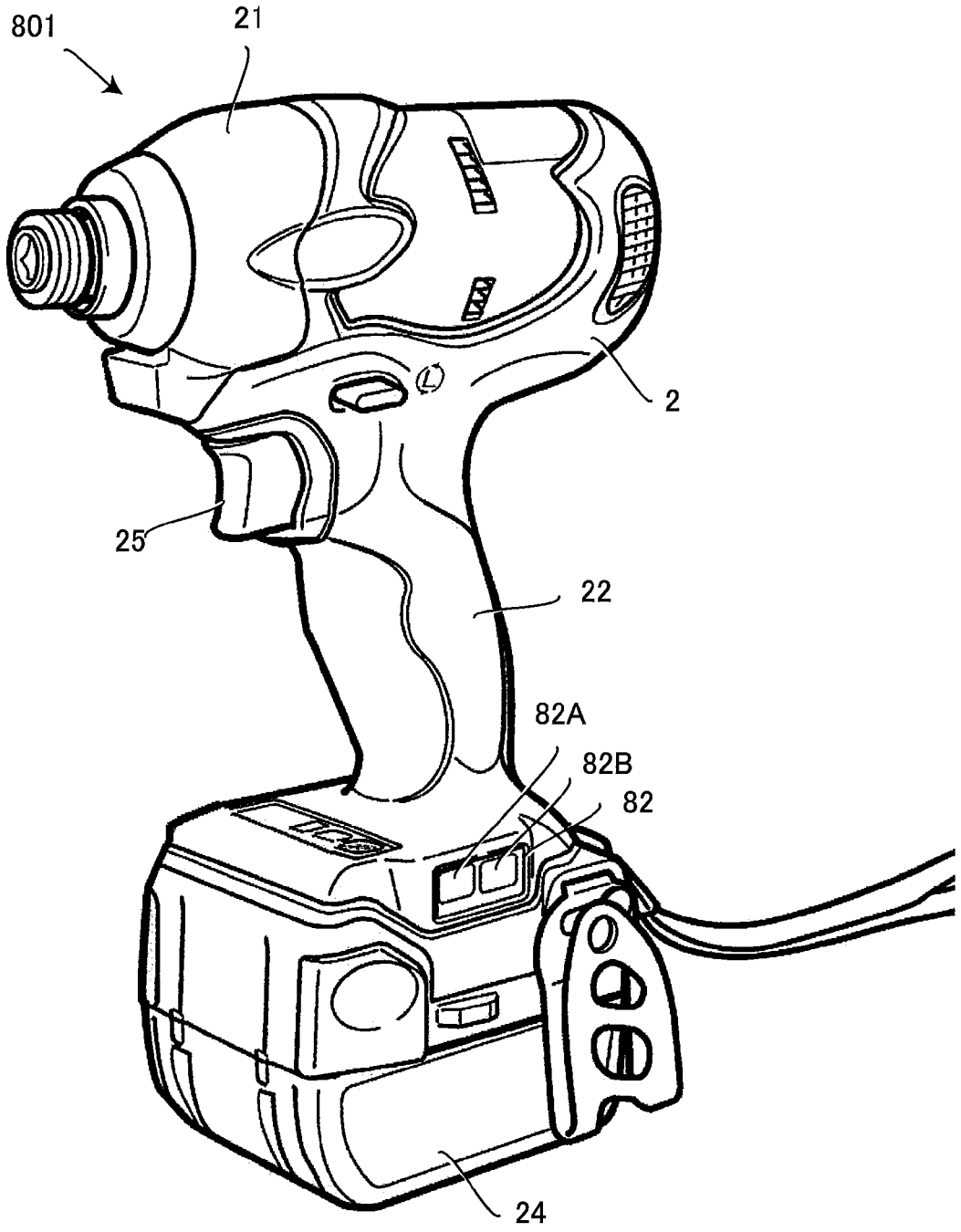
FIG. 29 is a perspective view of an impact tool according to an eighth embodiment of the invention.

As shown in FIG. 29, the impact tool 801 according to the present embodiment includes a tact switch 82 having a first button 82A for setting the mode to the impact mode and a second button 82B for setting the mode to the electronic pulse mode. Note that the impact tool 801 operates at the clutch mode when neither the first button 82A nor the second button 82B is selected.

When the clutch mode or the impact mode is selected, the impact tool 801 operates in a similar manner as the above embodiments. On the other hands, when the electronic pulse mode is selected, the impact tool 801 operates in a different manner from the above embodiments. The operation of the impact tool 801 when the electronic pulse mode is selected will be described referring to FIGS. 30 and 31.

Figure 30:
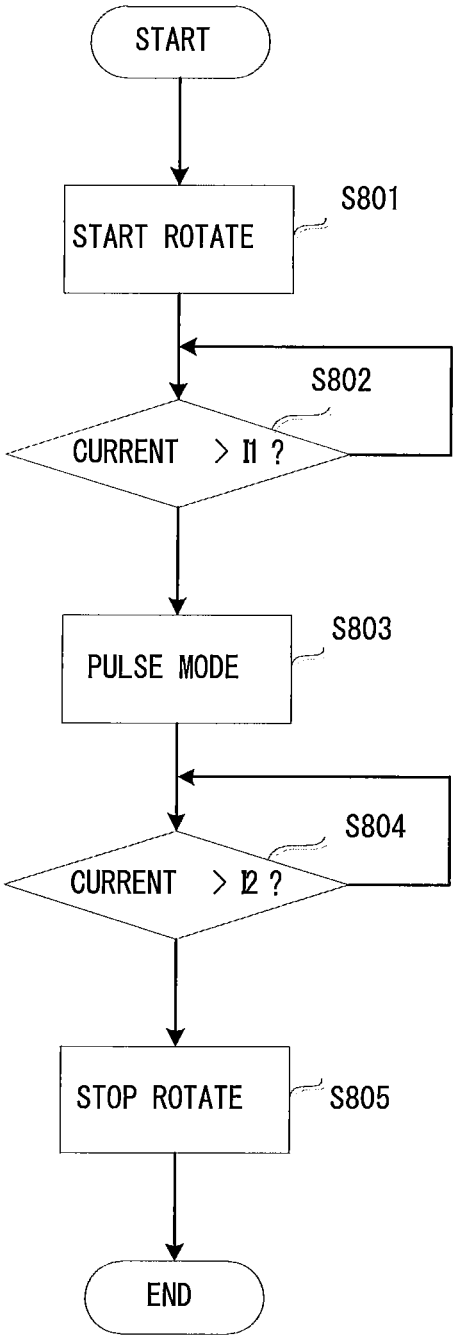
FIG. 30 is a flowchart showing controls of the impact tool in a pulse mode according to the eighth embodiment of the invention.
Figure 31:
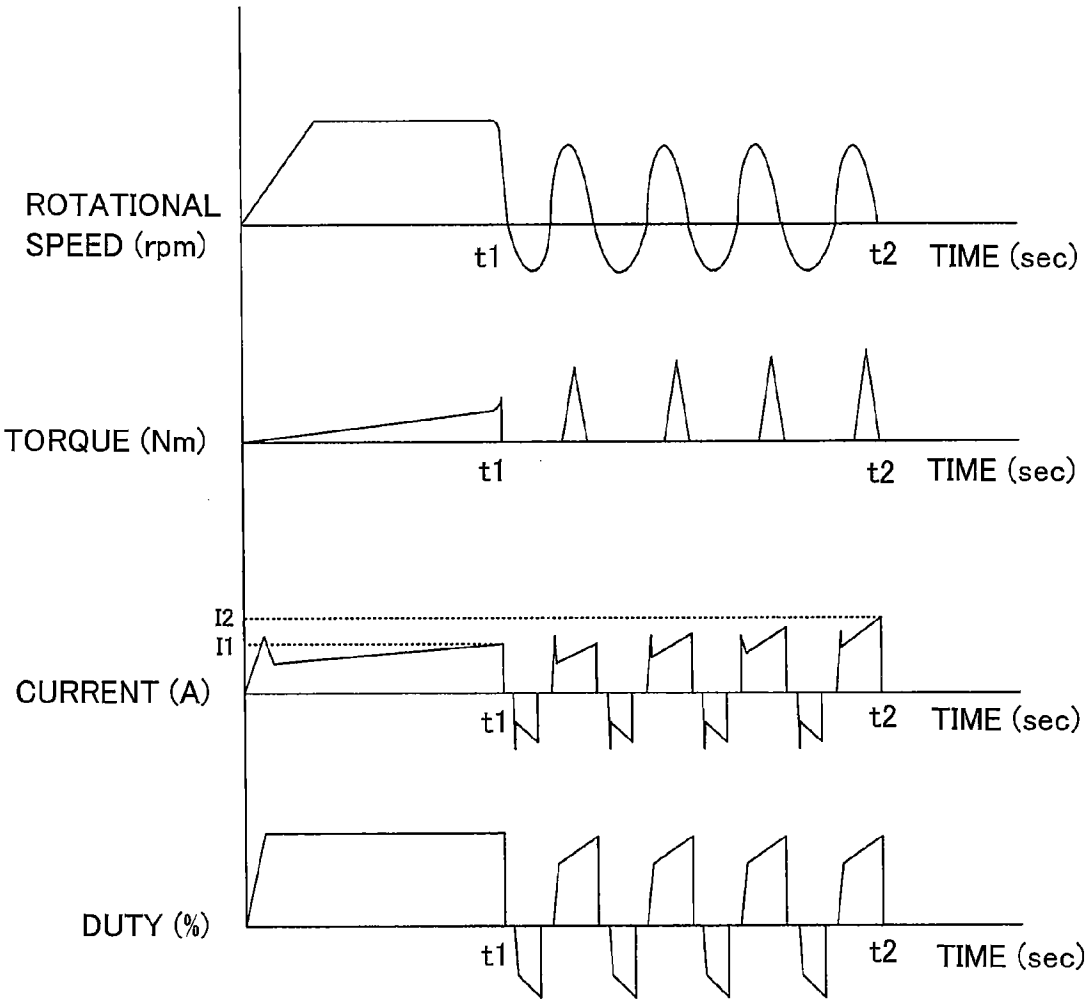
FIG. 31 is a diagram for illustrating controls of the impact tool in the pulse mode according to the eighth embodiment of the invention.

First, when the trigger 25 is turned on, the control section 7 drives the motor 3 in the forward direction to rotate the anvil 52 together with the hammer 42 (S801 of FIG. 30).

Then, when the current flowing into the motor 3 increases to a first current threshold I1 (for example, 5-20 A) smaller than a predetermined value at which the first engaging protrusion 42A (the second engaging protrusion 42B) rides over the first engaged protrusion 52A (the second engaged protrusion 52B) (S802 of FIG. 30: YES, t1 of FIG. 31), the control section 7 drives the motor 3 in the reverse direction to operate the hammer 42 in the electronic pulse mode (S803 of FIG. 30). Note that the motor 3 is driven in the reverse direction at a driving force such that the reversed first engaging protrusion 42A (the second engaging protrusion 42B) does not collides the second engaged protrusion 52B (the first engaged protrusion 52A) that is positioned at the reverse direction of the first engaging protrusion 42A (the second engaging protrusion 42B).

As the fastening work in the electronic pulse mode goes, the current flowing into (torque applied to) the motor 3 increases. If the current increases to the predetermined value, the first engaging protrusion 42A (the second engaging protrusion 42B) will ride over the first engaged protrusion 52A (the second engaged protrusion 52B). Therefore, when the current flowing into the motor 3 increases to a second current threshold I2 slightly smaller than the predetermined value (S804 of FIG. 30: YES, t2 of FIG. 31), the control section 7 stops the rotating of the motor 3 (S405 of FIG. 30).

Thus, the impact tool 801 achieves the electronic pulse mode with a simple construction although the hammer 42 is not fixed in the forward-rearward direction.

Further, since the impact tool 801 has a construction same as the conventional impact tool, the increase of the manufacturing cost is suppressed.

Further, the impact tool 801 according to the present embodiment can also operate at a combined mode of the impact mode and the electronic pulse mode. In this case, the impact tool 801 operates at the combined mode when both the first button 82A and the second button 82B are selected. The operation of the impact tool 801 when the combined mode is selected will be described referring to FIGS. 32 and 33.

Figure 32:
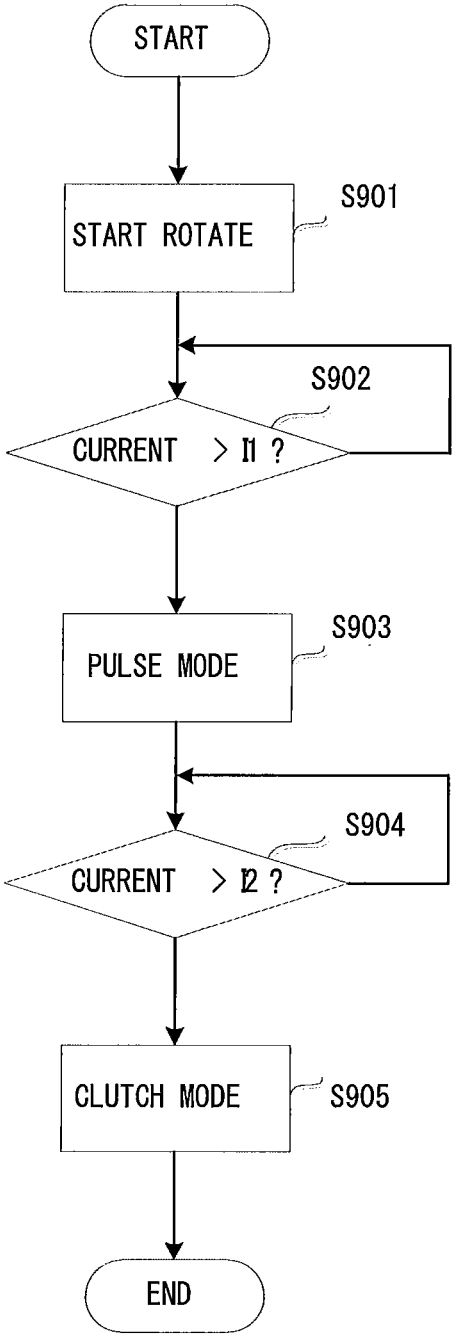
FIG. 32 is a flowchart showing controls of the impact tool in a combined mode according to the eighth embodiment of the invention.
Figure 33:
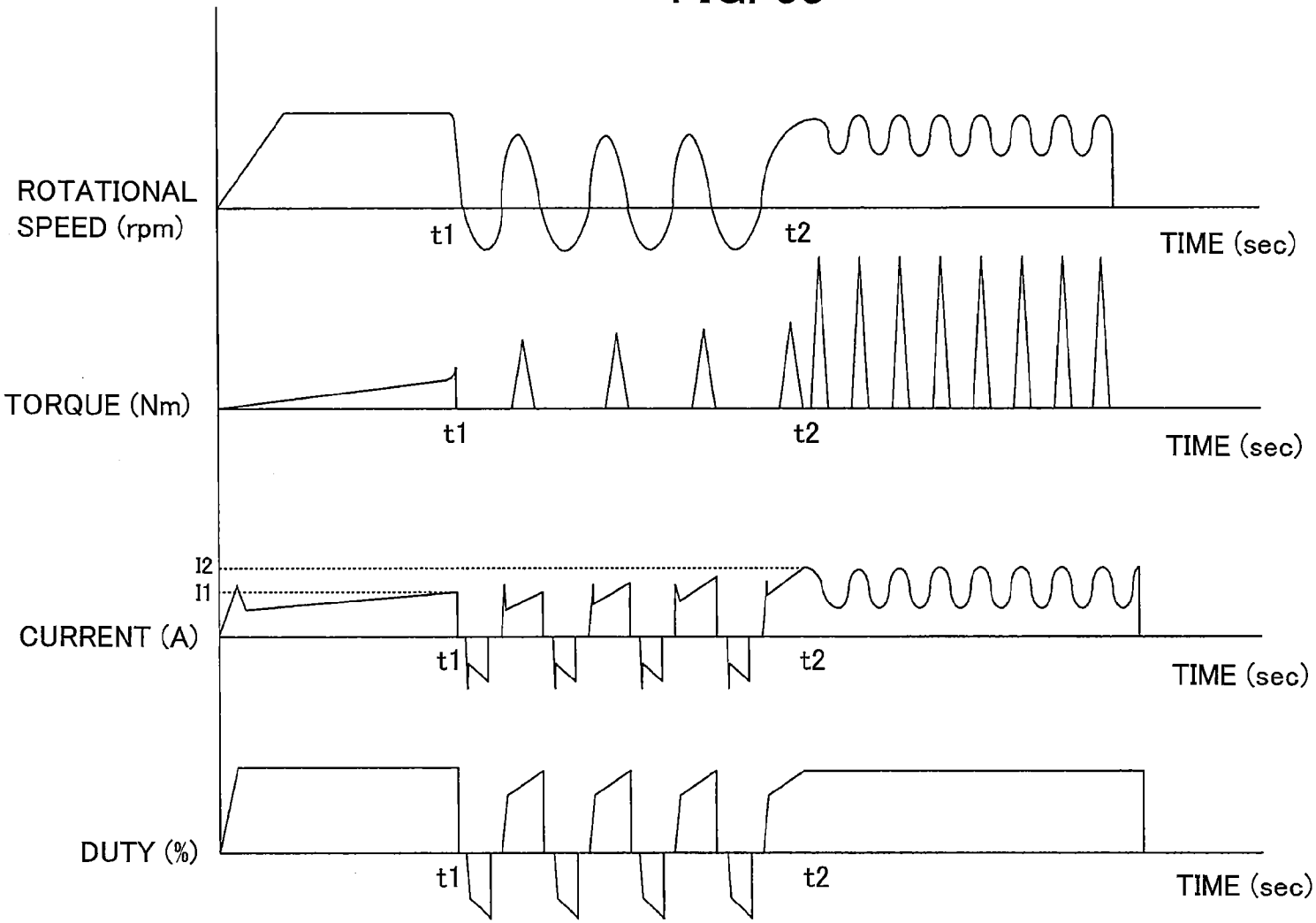
FIG. 33 is a diagram for illustrating controls of the impact tool in the combined mode according to the eighth embodiment of the invention.

First, the impact tool 801 operates as S801-S804 of FIG. 30 (S901-S904 of FIG. 32). Then, when the current flowing into the motor 3 increases to the second current threshold I2 (S904 of FIG. 32: YES, t2 of FIG. 33), the control section 7 drives the motor 3 in only the forward direction so that the impact tool 801 operates at the impact mode (S905 of FIG. 33).

Thus, the impact tool 801 can operate at the impact mode that gives the fastener a strong fastening power after the torque applied to the motor 3 increases to a predetermined value.

While the invention has been described in detail with reference to the above embodiments thereof, it would be apparent to those skilled in the art that various changes and modifications may be made therein without departing from the scope of the claims.

In the above-described embodiment, the gyro sensor 26A is provided on the board 26 to detect reaction that occurs in the handle section 22. However, a position sensor may be provided on the board 26 to detect reaction that occurs in the handle section 22 based on distance by which the handle section 22 is moved. Similarly, an acceleration sensor may be provided instead of the gyro sensor 26A.

However, because an output of the acceleration sensor is not linked directly to a traveling amount of the housing, the acceleration sensor is not suitable for detection of reaction. For example, the acceleration sensor outputs vibrations of the housing and the acceleration sensor itself, which are different from the actual travel of the housing. Accordingly, it is preferable to use a velocity sensor which is effective in indicating the traveling amount of the housing.

In the above-described embodiment, a gyro sensor is used to detect reaction. Alternatively, the traveling amount of the housing may be measured with a GPS, for example. In this case, if the traveling amount of the housing per unit time becomes larger than or equal to a predetermined value, the rotational direction of the motor is changed from the forward rotation to the reverse rotation. Also, an image sensor may be used instead of a GPS.

Alternatively, reaction may be detected by detecting a current instead of using a gyro sensor. However, there is a case in which reaction does not correspond to an output value of the current, and an output value of the gyro sensor always corresponds to reaction. Hence, reaction can be detected more accurately when the gyro sensor is used to detect reaction, than a case in which reaction is detected based on the current. Further, it is conceivable that a torque sensor is provided to the output shaft, instead of the gyro sensor. However, there is also a case in which an output of the torque sensor does not correspond to reaction, and the gyro sensor can detect reaction more accurately.

Although a monochromatic LED is used as the LED 26B in the above-described embodiment, a full color LED may be provided. In that case, the color may be changed depending on a mode set by the dial 27. Further, a color in each mode may be changed by providing color cellophanes at the dial 27. Also, a new informing light may be provided at the body section 21, so that the color of the informing light changes depending on the set mode. Thus, the operator can confirm the set mode at a position closer to his hand.

In the third embodiment, controls are performed so that rotation of the motor 3 is detected to prevent rotation. However, the rotor 3A may be so controlled that the above-described controls are performed only when the rotor 3A is rotated in the direction shown in FIG. 20 (*b*), and that a fastener is not rotated as shown in FIG. 17A (b) when the rotor 3A is rotated in the direction opposite from the direction shown in FIG. 20 (*b*). With this control, the electronic pulse driver can be used like a ratchet wrench, as the first embodiment.

In the fourth and fifth embodiments, the fans 432 and 532 stop automatically when the trigger 25 is off. However, if detection temperature of the thermistor 33B is higher than or equal to a predetermined value when the trigger 25 is turned off, the fans 432 and 532 may be driven automatically until the temperature falls below the predetermined value.

The invention claimed is:

1. A power tool comprising:

a motor;

a housing having: a body section accommodating the motor; and a handle section extending downward from the body section;

a trigger provided in the handle section and configured to be used to drive the motor;

a spindle having a rotational axis and configured to be rotated about the rotational axis by the motor, the rotational axis extending in a front direction;

a hammer being rotatable in a rotational direction by the motor and being movable, relative to the spindle, in the front direction and a rear direction;

an anvil disposed at front side of the hammer and configured to be stricken by the hammer in the rotational direction;

an operation member configured to move between a first position and a second position, the operation member being operated from outside of the housing, wherein the operation member restricts movement of the hammer in the rear direction when the operation member is at the first position, and the operation member allows the hammer to move in the rear direction when the operation member is at the second position; and a switching member configured to perform switching operation in conjunction with movement of the operation member between the first position and the second position, wherein modes to drive the motor are changed in conjunction with the switching operation of the switching member, wherein the switching member is positioned upper side of the trigger and in a lower portion of the body section.

2. The power tool according to claim 1, further comprising:

an end-bit mounting section positioned at front side of the anvil and configured to mount an end-bit; and a light emitting portion configured to emit light to the end-bit, wherein the light emitting portion is positioned at upper side of the trigger and lower side of the hammer and the switching member is positioned at rear side of the light emitting portion.

3. The power tool according to claim 1, wherein the modes includes an impact mode and a clutch mode, the impact mode and the clutch mode being selectively executed in conjunction with the switching operation of the switching member, wherein in the impact mode, the motor rotates in a normal rotational direction, the hammer is capable of moving in the rear direction, and the hammer repeatedly strikes the anvil, wherein in the clutch mode, the motor rotates in the normal rotational direction, the hammer is prevented from moving in the rear direction, and driving of the motor is stopped when a current flowing to the motor increases.

4. The power tool according to claim 1, further comprising:

a housing having a body section accommodating the motor and a handle section extending downward from the body section; and a trigger provided in the handle section and configured to be used to drive the motor, wherein the switching member is positioned upper side of the trigger and lower side of the hammer.

5. The power tool according to claim 1, further comprising a controller configured to control operation of the motor based on a plurality of inputs including an input from the trigger and an input from the switching member.

6. A power tool comprising:

a motor;

a housing having: a body section accommodating the motor; and a handle section extending downward from the body section;

a spindle having a rotational axis and configured to be rotated about the rotational axis by the motor, the rotational axis extending in a front direction;

a hammer being rotatable in a rotational direction by the motor and being movable, relative to the spindle, in the front direction and a rear direction;

an anvil disposed at front side of the hammer and configured to be stricken by the hammer in the rotational direction;

a switching lever configured to switch rotational direction of the motor from among a forward direction and a reverse direction;

an operation member configured to move between a first position and a second position, the operation member being operated from outside of the housing, wherein the operation member restricts movement of the hammer in the rear direction when the operation member is at the first position, and the operation member allows the hammer to move in the rear direction when the operation member is at the second position; and a switching member configured to perform switching operation in conjunction with movement of the operation member between the first position and the second position, wherein modes to drive the motor are changed in conjunction with the switching operation of the switching member, wherein the switching lever is positioned at upper side of the handle section, and the switching member is positioned at upper side of the switching lever.

7. The power tool according to claim 6, further comprising:

an end-bit mounting section positioned at front side of the anvil and configured to mount an end-bit; and a light emitting portion configured to emit light to the end-bit, wherein the light emitting portion is positioned at front side of the switching lever and front side of the switching member.

8. The power tool according to claim 6, further comprising a controller configured to control operation of the motor based on a plurality of inputs including an input from the switching member.

9. A power tool comprising:

a motor;

a spindle having a rotational axis and configured to be rotated about the rotational axis by the motor, the rotational axis extending in a front direction;

a hammer being rotatable in a rotational direction by the motor and being movable, relative to the spindle, in the front direction and a rear direction;

an anvil disposed at front side of the hammer and configured to be stricken by the hammer in the rotational direction;

an operation member configured to move between a first position and a second position, wherein the operation member restricts movement of the hammer in the rear direction when the operation member is at the first position and the operation member allows the hammer to move in the rear direction when the operation member is at the second position; and a switching member configured to perform switching operation in conjunction with movement of the operation member between the first position and the second position, wherein an impact mode and a clutch mode of controlling operation of the motor are selectively executed in conjunction with the switching operation of the switching member, wherein in the impact mode, the hammer is movable in the rear direction, and wherein in the clutch mode, the hammer is unmovable in the rear direction, wherein when the operation member is positioned at the first position, the clutch mode can be selected, and when the operation member is positioned at the second position, the impact mode is selected.

10. The power tool according to claim 9, further comprising a contact member configured to contact to and separate from the switching member to switch on and off the switching member, wherein when the operating member is positioned at the first position, the contact member contacts to the switching member whereas the operating member is positioned at the second position, the contact member separates from the switching member.

11. The power tool according to claim 9, further comprising:

a housing including a body section and a handle section, the body section accommodating the motor and the handle section extending from the body section; and a trigger provided in the handle section and operable to control rotation of the motor, wherein the hammer is closer to the rotational axis than the switching member, and wherein switching member is disposed closer to the rotational axis than the trigger and closer to the trigger than the rotational axis.

12. The power tool according to claim 9, further comprising a controller configured to control operation of the motor based on a plurality of inputs including an input from the switching member.

13. A power tool comprising:

a motor operable in a plurality of operating modes;

a housing including a body section and a handle section, the body section accommodating the motor and the handle section extending from the body section;

a trigger provided in the handle section and operable to control rotation of the motor;

a spindle configured to be rotated about a rotational axis by the motor;

a hammer rotatable in a rotational direction by the motor and movable, relative to the spindle, parallel to the rotational axis;

an anvil configured to be stricken by the hammer;

an operation member configured to be moved relative to the housing between a first position and a second position, the operation member being operated from outside of the housing, the operation member restricting movement of the hammer relative to the spindle parallel to the rotational axis when the operation member is at the first position, and the operation member being positioned to accommodate movement of the hammer relative to the spindle parallel to the rotational axis when the operation member is at the second position; and a switching member configured to perform switching operation in conjunction with movement of the operation member between the first position and the second position, wherein the operating mode of the motor is changed in conjunction with the switching operation of the switching member, wherein the switching member is disposed closer to the rotational axis than the trigger and closer to the trigger than the rotational axis.

14. The power tool according to claim 13, further comprising:

an end-bit mounting section rotationally coupled with the anvil and configured to hold an end-bit; and a light emitting element configured to emit light to illuminate the end-bit, wherein the light emitting element is positioned closer to the rotational axis than the trigger and the switching member is positioned closer to the motor than the light emitting element.

15. The power tool according to claim 13, further comprising a controller configured to control operation of the motor based on a plurality of inputs including an input from the trigger and an input from the switching member.

16. A power tool comprising:

a motor operable in a plurality of operating modes;

a housing including a body section and a handle section, the body section accommodating the motor and the handle section extending from the body section;

a spindle configured to be rotated about a rotational axis by the motor;

a hammer rotatable in a rotational direction by the motor and movable, relative to the spindle, parallel to the rotational axis;

an anvil configured to be stricken by the hammer;

a rotation direction switching lever operable to select a rotational direction of the motor;

an operation member configured to be moved relative to the housing between a first position and a second position, the operation member being operated from outside of the housing, the operation member restricting movement of the hammer relative to the spindle parallel to the rotational axis when the operation member is at the first position, and the operation member being positioned to accommodate movement of the hammer relative to the spindle parallel to the rotational axis when the operation member is at the second position; and a switching member configured to perform switching operation in conjunction with movement of the operation member between the first position and the second position, wherein the operating mode of the motor is changed in conjunction with the switching operation of the switching member, and wherein the switching member is positioned closer to the rotational axis than the rotation direction switching lever and closer to the switching lever than the rotational axis.

17. The power tool according to claim 16, further comprising:

an end-bit mounting section rotationally coupled with the anvil and configured to hold an end-bit; and a light emitting element configured to emit light to illuminate the end-bit, wherein the light emitting element is positioned further from the motor than each of the switching member and the rotational direction switching lever.

18. The power tool according to claim 16, further comprising a controller configured to control operation of the motor based on a plurality of inputs including an input from the switching member.

* * * * *